US008197235B2

(12) United States Patent
Davis

(10) Patent No.: US 8,197,235 B2
(45) Date of Patent: Jun. 12, 2012

(54) INFUSION PUMP WITH INTEGRATED PERMANENT MAGNET

(76) Inventor: David L. Davis, Poway, CA (US)

( * ) Notice: Subject to any disclaimer, the term of this patent is extended or adjusted under 35 U.S.C. 154(b) by 635 days.

(21) Appl. No.: 12/388,411

(22) Filed: Feb. 18, 2009

(65) Prior Publication Data

US 2010/0209267 A1 Aug. 19, 2010

(51) Int. Cl.
*F04B 43/08* (2006.01)

(52) U.S. Cl. ..... 417/474; 417/410.1; 417/44.1

(58) Field of Classification Search ..... 41/474; 417/44.1, 50, 353, 410.1, 505; 604/65–67, 604/151–155, 131
See application file for complete search history.

(56) References Cited

U.S. PATENT DOCUMENTS

| | | | |
|---|---|---|---|
| 119,996 | A | 10/1871 | Randall |
| 1,425,191 | A | 8/1922 | Garbarini |
| 1,886,514 | A | 11/1932 | Angelini |
| 2,240,307 | A | 4/1941 | List |
| 2,816,514 | A | 12/1957 | Freese |
| 2,849,159 | A | 8/1958 | Kaufmann |
| 3,163,176 | A | 12/1964 | Darling |
| 3,218,935 | A | 11/1965 | York et al. |
| 3,252,623 | A | 5/1966 | Corbin et al. |
| 3,278,153 | A | 10/1966 | Dallas |
| 3,298,320 | A | 1/1967 | Latham, Jr. |
| 3,401,711 | A | 9/1968 | Kubilos |
| 3,450,153 | A | 6/1969 | Hildebrandt et al. |
| 3,460,572 | A | 8/1969 | Hartman |
| 3,559,644 | A | 2/1971 | Stoft et al. |
| 3,601,124 | A | 8/1971 | Petree |
| 3,620,650 | A | 11/1971 | Shaw |
| 3,756,556 | A | 9/1973 | Georgi |
| 3,768,931 | A | 10/1973 | Willis, Jr. |
| 3,800,794 | A | 4/1974 | Georgi |
| 3,817,237 | A | 6/1974 | Bolduc |
| 3,842,440 | A | 10/1974 | Karlson |
| 3,890,968 | A | 6/1975 | Pierce et al. |
| 3,976,402 | A | 8/1976 | Lundquist |
| 4,037,598 | A | 7/1977 | Georgi |
| 4,121,584 | A | 10/1978 | Turner et al. |
| 4,126,132 | A | 11/1978 | Portner et al. |
| 4,142,524 | A | 3/1979 | Jassawalla et al. |
| 4,185,759 | A | 1/1980 | Zissimopoulos |
| 4,199,307 | A | 4/1980 | Jassawalla |
| 4,204,538 | A | 5/1980 | Cannon |
| 4,207,871 | A | 6/1980 | Jenkins |
| 4,258,711 | A | 3/1981 | Tucker et al. |
| 4,261,356 | A | 4/1981 | Turner et al. |

(Continued)

FOREIGN PATENT DOCUMENTS

WO WO 2004/044424 A1 5/2004

(Continued)

*Primary Examiner* — Anne Hines
(74) *Attorney, Agent, or Firm* — Knobbe Martens Olson & Bear LLP

(57) ABSTRACT

Described herein is an infusion pump with an integrated permanent magnet. The permanent magnet is positioned to provide an attractive force that moves an armature to compress a fluid-filled infusion tube. An electromagnet can be activated to overcome the attractive force of the permanent magnet and move the armature away from the infusion tubing. The force required to overcome the permanent magnet is much less than the force required to compress the tubing. For this reason the infusion pump has very low power consumption since much of the pumping work is provided by the permanent magnet.

18 Claims, 16 Drawing Sheets

U.S. PATENT DOCUMENTS

| | | | |
|---|---|---|---|
| 4,262,668 | A | 4/1981 | Schmidt |
| 4,262,824 | A | 4/1981 | Hrynewycz |
| 4,266,697 | A | 5/1981 | Zissimopoulos |
| 4,273,121 | A | 6/1981 | Jassawalla |
| 4,274,407 | A | 6/1981 | Scarlett |
| 4,302,854 | A | 12/1981 | Runge |
| 4,338,932 | A | 7/1982 | Georgi et al. |
| 4,360,019 | A | 11/1982 | Portner et al. |
| 4,373,527 | A | 2/1983 | Fischell |
| 4,378,014 | A | 3/1983 | Elkow |
| 4,394,862 | A | 7/1983 | Shim |
| 4,395,259 | A | 7/1983 | Prestele et al. |
| 4,398,542 | A | 8/1983 | Cunningham et al. |
| 4,431,425 | A | 2/1984 | Thompson et al. |
| 4,437,815 | A | 3/1984 | McMullin |
| 4,444,548 | A | 4/1984 | Andersen et al. |
| 4,447,232 | A | 5/1984 | Sealfon et al. |
| 4,456,009 | A | 6/1984 | Vcelka et al. |
| 4,488,099 | A | 12/1984 | Laforge et al. |
| 4,493,709 | A | 1/1985 | Smith |
| 4,519,792 | A | 5/1985 | Dawe |
| 4,529,401 | A | 7/1985 | Leslie et al. |
| 4,541,429 | A | 9/1985 | Prosl et al. |
| 4,551,134 | A | 11/1985 | Slavik et al. |
| 4,557,726 | A | 12/1985 | Reinicke |
| 4,561,830 | A | 12/1985 | Bradley |
| 4,581,018 | A | 4/1986 | Jassawalla et al. |
| 4,594,058 | A | 6/1986 | Fischell |
| 4,601,702 | A | 7/1986 | Hudson |
| 4,602,249 | A | 7/1986 | Abbott |
| 4,624,661 | A | 11/1986 | Arimond |
| 4,626,241 | A | 12/1986 | Campbell et al. |
| 4,627,419 | A | 12/1986 | Hills |
| 4,636,149 | A | 1/1987 | Brown |
| 4,657,486 | A | 4/1987 | Stempfle et al. |
| 4,657,490 | A | 4/1987 | Abbott |
| 4,662,872 | A | 5/1987 | Can'e |
| 4,673,391 | A | 6/1987 | Kondo et al. |
| 4,684,368 | A | 8/1987 | Kenyon |
| 4,715,852 | A | 12/1987 | Reinicke et al. |
| 4,838,857 | A | 6/1989 | Strowe et al. |
| 4,850,807 | A | 7/1989 | Frantz |
| 4,856,339 | A | 8/1989 | Williams |
| 4,857,048 | A | 8/1989 | Simons et al. |
| 4,884,013 | A | 11/1989 | Jackson et al. |
| 4,907,723 | A | 3/1990 | Katz |
| 4,925,451 | A | 5/1990 | Amendolla |
| 4,943,279 | A | 7/1990 | Samiotes et al. |
| 4,950,245 | A | 8/1990 | Brown et al. |
| 4,968,229 | A | 11/1990 | Neuder |
| 4,985,015 | A | 1/1991 | Obermann et al. |
| 5,017,059 | A | 5/1991 | Davis |
| 5,039,279 | A | 8/1991 | Natwick et al. |
| 5,041,086 | A | 8/1991 | Koenig et al. |
| 5,056,992 | A | 10/1991 | Simons et al. |
| 5,074,756 | A | 12/1991 | Davis |
| 5,105,983 | A | 4/1992 | Sancoff et al. |
| 5,151,019 | A | 9/1992 | Danby et al. |
| 5,176,360 | A | 1/1993 | Winchell et al. |
| 5,219,279 | A | 6/1993 | Natwick et al. |
| 5,221,268 | A | 6/1993 | Barton et al. |
| 5,224,843 | A | 7/1993 | VanLintel |
| 5,232,439 | A | 8/1993 | Campbell et al. |
| 5,244,463 | A | 9/1993 | Cordner, Jr. et al. |
| 5,246,347 | A | 9/1993 | Davis |
| 5,250,027 | A | 10/1993 | Lewis et al. |
| 5,256,157 | A | 10/1993 | Samiotes et al. |
| 5,294,022 | A | 3/1994 | Earle |
| 5,316,444 | A | 5/1994 | Wicnienski |
| 5,320,502 | A | 6/1994 | Davis |
| 5,320,503 | A | 6/1994 | Davis |
| 5,322,422 | A | 6/1994 | Natwick et al. |
| 5,357,967 | A | 10/1994 | Dixon et al. |
| 5,364,364 | A | 11/1994 | Kasvikis et al. |
| 5,368,562 | A | 11/1994 | Blomquist et al. |
| 5,398,851 | A | 3/1995 | Sancoff et al. |
| 5,423,749 | A | 6/1995 | Merte et al. |
| 5,462,525 | A | 10/1995 | Srisathapat et al. |
| 5,464,388 | A | 11/1995 | Merte et al. |
| 5,482,438 | A * | 1/1996 | Anderson et al. ..... 417/44.1 |
| 5,503,538 | A | 4/1996 | Wiernicki et al. |
| 5,514,106 | A | 5/1996 | D'Silva |
| 5,553,741 | A | 9/1996 | Sancoff et al. |
| 5,558,255 | A | 9/1996 | Sancoff et al. |
| 5,567,616 | A | 10/1996 | Dill, II |
| 5,575,631 | A | 11/1996 | Jester |
| 5,584,667 | A | 12/1996 | Davis |
| 5,588,556 | A | 12/1996 | Sancoff et al. |
| 5,616,124 | A | 4/1997 | Haque et al. |
| 5,630,710 | A | 5/1997 | Tune et al. |
| 5,632,606 | A | 5/1997 | Jacobsen et al. |
| 5,647,854 | A | 7/1997 | Olsen et al. |
| 5,658,250 | A | 8/1997 | Blomquist et al. |
| 5,658,252 | A | 8/1997 | Johnson |
| 5,660,728 | A | 8/1997 | Saaski et al. |
| 5,665,070 | A | 9/1997 | McPhee |
| 5,681,285 | A | 10/1997 | Ford et al. |
| 5,683,233 | A | 11/1997 | Moubayed et al. |
| 5,685,844 | A | 11/1997 | Marttila |
| 5,700,245 | A | 12/1997 | Sancoff et al. |
| 5,702,618 | A | 12/1997 | Saaski et al. |
| 5,711,654 | A | 1/1998 | Afflerbaugh |
| 5,745,378 | A | 4/1998 | Barker et al. |
| 5,769,608 | A | 6/1998 | Seale |
| 5,772,635 | A | 6/1998 | Dastur et al. |
| 5,781,442 | A | 7/1998 | Engleson et al. |
| 5,788,669 | A | 8/1998 | Peterson |
| 5,788,674 | A | 8/1998 | McWilliams |
| 5,791,881 | A | 8/1998 | Moubayed et al. |
| 5,803,712 | A | 9/1998 | Davis et al. |
| 5,807,075 | A | 9/1998 | Jacobsen et al. |
| 5,842,841 | A | 12/1998 | Danby et al. |
| 5,848,988 | A | 12/1998 | Davis |
| 5,853,386 | A | 12/1998 | Davis et al. |
| 5,876,187 | A | 3/1999 | Afromowitz et al. |
| 5,885,245 | A | 3/1999 | Lynch et al. |
| 5,897,530 | A | 4/1999 | Jackson |
| 5,915,929 | A | 6/1999 | Falk et al. |
| 5,924,852 | A | 7/1999 | Moubayed et al. |
| 5,928,194 | A | 7/1999 | Maget |
| 5,935,099 | A | 8/1999 | Peterson et al. |
| 5,935,106 | A | 8/1999 | Olsen |
| 5,938,640 | A | 8/1999 | Maget et al. |
| 5,941,848 | A | 8/1999 | Nishimoto et al. |
| 5,947,692 | A | 9/1999 | Sahlin et al. |
| 5,961,487 | A | 10/1999 | Davis |
| 5,980,489 | A | 11/1999 | Kriesel |
| 5,980,501 | A | 11/1999 | Gray |
| 6,003,737 | A | 12/1999 | Mascitelli |
| 6,010,316 | A | 1/2000 | Hatter et al. |
| 6,010,492 | A | 1/2000 | Jacobsen et al. |
| 6,012,902 | A | 1/2000 | Parce |
| 6,016,974 | A | 1/2000 | Mascitelli |
| 6,024,539 | A | 2/2000 | Blomquist |
| 6,033,377 | A | 3/2000 | Rasmussen et al. |
| 6,053,887 | A | 4/2000 | Levitas et al. |
| 6,056,734 | A | 5/2000 | Jacobsen et al. |
| 6,063,052 | A | 5/2000 | Uber, III et al. |
| 6,070,761 | A | 6/2000 | Bloom et al. |
| 6,077,055 | A | 6/2000 | Vilks |
| 6,090,064 | A | 7/2000 | Reilly et al. |
| 6,110,153 | A | 8/2000 | Davis et al. |
| 6,110,410 | A | 8/2000 | Owens et al. |
| 6,116,257 | A | 9/2000 | Yokota et al. |
| 6,123,686 | A | 9/2000 | Olsen et al. |
| 6,126,140 | A | 10/2000 | Johnson et al. |
| 6,136,212 | A | 10/2000 | Mastrangelo et al. |
| 6,146,103 | A | 11/2000 | Lee et al. |
| 6,146,109 | A | 11/2000 | Davis et al. |
| 6,164,921 | A | 12/2000 | Moubayed et al. |
| 6,168,395 | B1 | 1/2001 | Quenzer et al. |
| 6,171,276 | B1 | 1/2001 | Lippe et al. |
| 6,179,584 | B1 | 1/2001 | Howitz et al. |
| 6,183,441 | B1 | 2/2001 | Kriesel et al. |
| 6,183,461 | B1 | 2/2001 | Matsuura et al. |
| 6,193,477 | B1 | 2/2001 | Falk et al. |
| 6,195,887 | B1 | 3/2001 | Danby et al. |

6,213,738 B1 4/2001 Danby et al.
6,213,739 B1 4/2001 Phallen et al.
6,227,809 B1 5/2001 Forster et al.
6,227,818 B1 5/2001 Falk et al.
6,227,824 B1 5/2001 Stehr
6,231,545 B1 5/2001 Kriesel et al.
6,241,480 B1 6/2001 Chu et al.
6,241,704 B1 6/2001 Peterson et al.
6,269,340 B1 7/2001 Ford et al.
6,296,450 B1 10/2001 Westberg et al.
6,309,189 B1 10/2001 Rey-Mermet et al.
6,312,227 B1 11/2001 Davis
6,347,553 B1 2/2002 Morris et al.
6,368,079 B2 4/2002 Peters et al.
6,371,732 B1 4/2002 Moubayed et al.
6,383,165 B1 5/2002 Maget et al.
6,390,791 B1 5/2002 Maillefer et al.
6,398,760 B1 6/2002 Danby
6,402,717 B1 6/2002 Reilly et al.
6,402,718 B1 6/2002 Reilly et al.
6,408,884 B1 6/2002 Kamholtz et al.
6,413,238 B1 7/2002 Maget
6,415,821 B2 7/2002 Kamholtz et al.
6,416,495 B1 7/2002 Kriesel et al.
6,458,256 B1 10/2002 Zhong
6,475,192 B1 11/2002 Reilly et al.
6,481,984 B1 11/2002 Shinohara et al.
6,520,753 B1 2/2003 Grosjean et al.
6,523,414 B1 2/2003 Malmstrom et al.
6,530,217 B1 3/2003 Yokota et al.
6,530,755 B2 3/2003 Ingenhoven et al.
6,537,268 B1 3/2003 Gibson et al.
6,547,755 B1 4/2003 Lippe et al.
6,551,083 B2 4/2003 Weisener et al.
6,554,591 B1 4/2003 Dai et al.
6,554,822 B1 4/2003 Holschneider et al.
6,562,008 B1 5/2003 Reilly et al.
6,568,910 B1 5/2003 Parce
6,582,393 B2 6/2003 Sage, Jr.
6,585,499 B2 7/2003 Nguyen et al.
6,589,198 B1 7/2003 Soltanpour et al.
6,620,273 B2 9/2003 Dai et al.
6,641,562 B1 11/2003 Peterson
6,641,566 B2 11/2003 Douglas et al.
6,644,117 B1 11/2003 Kueck et al.
6,655,923 B1 12/2003 Lisec et al.
6,656,162 B2 12/2003 Santini, Jr. et al.
6,669,663 B1 12/2003 Thompson
6,671,563 B1 12/2003 Engelson et al.
6,679,862 B2 1/2004 Diaz et al.
6,689,091 B2 2/2004 Bui et al.
6,690,280 B2 2/2004 Citrenbaum et al.
6,695,004 B1 2/2004 Raybuck
6,726,655 B1 4/2004 Lieberman et al.
6,731,989 B2 5/2004 Engleson et al.
6,733,478 B2 5/2004 Reilly et al.
6,740,059 B2 5/2004 Flaherty
6,742,992 B2 6/2004 Davis
6,749,587 B2 6/2004 Flaherty
6,805,693 B2 10/2004 Gray et al.
6,808,513 B2 10/2004 Reilly et al.
6,880,564 B2 4/2005 Erickson
6,908,452 B2 6/2005 Diaz et al.
6,915,170 B2 7/2005 Engleson et al.
6,958,053 B1 10/2005 Reilly
6,960,192 B1 11/2005 Flaherty et al.
6,985,870 B2 1/2006 Martucci et al.
6,997,905 B2 2/2006 Gillespie, Jr. et al.
6,997,911 B2 2/2006 Klitmose
7,006,894 B2 2/2006 de la Huerga
7,018,361 B2 3/2006 Gillespie, Jr. et al.
7,029,459 B2 4/2006 Reilly
7,048,715 B2 5/2006 Diaz et al.
7,061,831 B2 6/2006 De La Huerga
7,096,072 B2 8/2006 Engleson et al.
7,103,419 B2 9/2006 Engleson et al.
7,107,106 B2 9/2006 Engleson et al.
7,117,041 B2 10/2006 Engleson et al.
7,152,469 B2 12/2006 Milleker et al.
7,163,381 B1 1/2007 Barak
7,171,277 B2 1/2007 Engleson et al.
7,216,802 B1 5/2007 De La Huerga
7,255,680 B1 8/2007 Gharib
7,303,549 B2 12/2007 Flaherty et al.
7,337,922 B2 3/2008 Rake et al.
7,347,836 B2 3/2008 Peterson et al.
7,462,163 B2 12/2008 Yap et al.
2006/0051218 A1 3/2006 Harttig
2006/0140798 A1 6/2006 Kutsuzawa
2009/0240201 A1 9/2009 Rotem et al.

FOREIGN PATENT DOCUMENTS

WO WO 2007/033025 3/2007

* cited by examiner

INFUSION PUMP WITH INTEGRATED PERMANENT MAGNET

BACKGROUND OF THE INVENTION

1. Field of the Invention

This invention relates generally to a medication infusion device for administering fluid to patients and more particularly to an improved infusion pump with integral flow monitor that is small, inexpensive to manufacture, disposable, and very power efficient.

2. Description of the Related Art

Infusion Devices

Current generation infusion pumps are costly to use. They are difficult to program and require significant resources to properly train medical personnel in their use. The infusion pumps usually require devices that allow the loading and unloading of the cassette and connection to a source of AC power. The pumps require high front-end capital equipment costs and expensive routine maintenance. They typically become obsolete in a few years and must be replaced by newer technology pumps. Pump replacement not only results in high capital equipment costs but also typically requires costly retraining of medical personnel in their use. Investment in these high front-end capital equipment and training costs also forces an unearned "loyalty" to the particular infusion pump provider that further increases the user's costs by stifling competition and restricting the adoption of newer, better, or less expensive infusion pump technologies. Additionally, the disposable cassettes require costly features to precisely interface with the pump and to prevent uncontrolled free flow of fluid to the patient when incorrectly loaded or unloaded. Further, the size and weight of current generation pumps make mobile care difficult and expensive, especially in military applications when they must be transported long distances or in battlefield environments.

As a result of the ongoing need for improved health care, there is a continuous effort to reduce the cost of and to improve the administration of intravenous fluids from infusion devices. As is well known, medication dispensers and infusion devices are used for infusion of predetermined amounts of medication into the body of a patient. Various types of medication dispensers employing different techniques for a variety of applications are known to exist.

Primary types of prior art infusion devices are commonly known as controllers, pumps, disposable elastomeric pumps, and mechanical pumps.

Controllers are infusion devices that control the rate of flow of a gravity infusion. They are limited in use because they are unable to generate positive pressure over and above that provided by gravity. Many infusions require the generation of pressure to overcome pressure losses due to filters or other devices in the fluid path to the patient. Arterial infusions can also require positive pressure to overcome the high blood pressures involved.

Infusion pumps are able to generate positive pressure over and above that provided by gravity and are typically a preferred infusion device. Prior art devices demonstrate a complexity of design in order to sense the presence of tubing, sense the disposable cassette loading operation, control the motor, gear down or reduce the speed of the pumping mechanism, sense upstream and downstream occlusions, and sense the proper operation of the motor. They typically require a complex pumping mechanism with a platen, cams, cam followers, gears or belts, and pressure sensors. The motor drives typically require a costly encoder wheel to sense the position of the motor or cam.

Disposable elastomeric pumps utilize an elastic membrane to form a reservoir to contain and then "squeeze" the medication therefrom. A precision orifice usually controls the rate of infusion. As the elastomeric container empties, the pressure inside can vary significantly which can change the infusion rate. The infusion rate can also vary depending on the viscosity of the infused medication. These devices are typically disposable and utilized for a single infusion.

Mechanical pumps can utilize a spring mechanism in combination with a precision orifice to control the infusion rate. A disposable medication container is loaded into the device. The spring mechanism then squeezes the medication out of the container and through the controlling orifice to the patient. Although mechanical pumps are able to generate positive pressure, they typically cannot detect actual fluid flow nor can they adjust flow rate based on the presence of restrictions in the fluid path. The disposable medication container is used once and discarded after use. Since the infusion rate is dependent on the forces exerted by the spring mechanism, complex mechanisms are required to generate an infusion rate that is accurate from the beginning of the infusion when the reservoir is full to the end of the infusion when the reservoir is empty.

An example of a controller is shown in U.S. Pat. No. 4,626,241 to Campbell et al. The controlling mechanism in this reference can only control the rate of the gravity infusion by repetitively opening and closing a control valve. This device not only has the disadvantages inherent in a controller but also has several other problems in its implementation. The device has limited ability to accurately monitor the volume or rate of the infusion. It uses a drop sensor to count the number of drops infused. It is well known that drop size varies wildly with not only drip chamber canulla size and the rate of infusion, but also with the type of medication being infused.

Another example of a controller mechanism is demonstrated in U.S. Pat. Nos. 4,121,584 and 4,261,356 to Turner et al. This device is further improved in U.S. Pat. No. 4,185,759 to Zissimopoulos, U.S. Pat. No. 4,262,668 to Schmidt, U.S. Pat. No. 4,262,824 to Hrynewycz, and U.S. Pat. No. 4,266,697 to Zissimopoulus. The improved design uses a combination of gravity pressure, a permanent magnet, and an electromagnet to alternately open and close two valves to sequentially fill and empty a fluid chamber. This controller design also operates with gravity flow and has no capability to generate positive fluid pressure as is required in many clinical applications. This design requires a very complex cassette and has no capability to monitor the presence or absence of flow. The presence of an occlusion or empty reservoir cannot be detected by the mechanism. A low head height or low fluid reservoir results in a reduction of the rate of infusion. This type of undetected under-infusion can be hazardous to patient safety.

The implementations of this design in U.S. Pat. No. 4,262,824 to Hrynewycz utilizes the combination of permanent magnets and electromagnets to provide a bistable rocker arm motion to sequentially open and close cassette valves. The permanent magnet(s) are utilized to force one or the other of the two valves to a closed position when power is interrupted, thereby stopping potentially hazardous free flow of fluid to the patient.

The implementation of the design in U.S. Pat. No. 4,266,697 to Zissimopoulos provides a plunger means for the valve members. The design utilizes a very complex combination of magnets, a leaf spring, coil springs, and plungers to implement a bistable valving function that reduces the wear on the valve membrane.

The ability of an infusion pump to generate positive pressure greatly increases its clinical acceptability. Prior art devices, however, demonstrated greatly increased complexity of design. An example of such an infusion pump is in U.S. Pat. No. 6,371,732 to Moubayed et al. The invention includes a variable speed motor with a complex motor speed control, a worm and worm gear, a complex cam and cam follower with roller members and pinch members and pinch fingers and biasing springs. The invention also requires an optical sensor, two pressure sensors with beams and strain gages, a platen sensor, and a tubing sensor. The invention also requires a shut-off valve and an encoder wheel.

An example of a disposable elastomeric pump is shown in U.S. Pat. No. 5,398,851 to Sancoff et al. It can be seen that the shape of the device is bulky and inconvenient for a patient to wear unobtrusively. The device requires an expensive elastomeric membrane to contain the medication and force it through the controlling orifice to the patient. It is disposable and typically filled only once for a single infusion then discarded.

An example of a mechanical pump is shown in U.S. Pat. No. 7,337,922 to Rake et al. It can be seen that the spring mechanism of a preferred embodiment includes two lateral springs and a complex mechanism. Complexity is added to the mechanism to provide a low profile package that is less bulky for the patient to wear. Although large forces are not required to load the infusion reservoir, large forces can be required to force the spring mechanism closed around the reservoir. Additional complexity is added to the mechanism to help reduce the resulting forces and the larger the medication bag, the larger the forces involved. This typically limits the usage of this type of device to fluid reservoirs of a few hundred milliliters or less while many commercially available fluid reservoir bags are one liter in size.

Occlusion Detection Devices

In many cases it is of critical importance to provide an infusion pump that can effectively detect fluid path occlusions either upstream (from the supply reservoir) or downstream (to the patient) in a timely manner. These needs are only partially fulfilled by prior art infusion pumps. Specifically, the occurrence of an occlusion in the pump's medication supply tube or output tube may endanger the patient without warning. If, for example, the supply reservoir is empty, or the supply tube becomes kinked, pinched, or otherwise blocked, the supply of medication to the patient will cease. As the continued supply of some medications is necessary to sustain the patient or remedy the patient's condition, cessation of supply may even be life threatening. Yet, with some infusion devices, such an occlusion would either go unnoticed or require an excessive amount of time to be detected. Some prior art devices such as that described in U.S. Pat. No. 4,398,542 to Cunningham et al. utilize a pressure transducer and membrane to monitor fluid pressure as an indicator of an occlusion.

Still other prior art devices such as that described in U.S. Pat. No. 6,371,732 to Moubayed et al. use strain gages to measure changes in the diameter of tubing as a means of detecting occlusions.

Still other prior art devices as described in U.S. Pat. No. 6,110,153 to Davis et al., utilize a complex optical system to detect changes in the diameter of tubing resulting from upstream occlusions. These devices require costly optical components, expend significant amounts of power to excite the elements, and require precise alignment to operate properly.

Programming Devices

Programming devices for infusion pumps are well known. Devices such as shown in U.S. Design Pat. No. 282,002 to Manno et al. utilize an array of push button switches to select a program value and an electronic display to display the selected value. Devices such as that shown in U.S. Pat. No. 4,037,598 to Georgi utilize switches that can both select the program value and display the selected value on a printed switch assembly. These devices cannot be programmed remotely nor can they be attached or made part of the fluid reservoir.

U.S. Pat. No. 4,943,279 to Samiotes et al. discloses an infusion device that uses an attached magnetic label. The label includes a display of the drug name and concentration with a set of parameter scales that surround the manual controls on the pump when the label is attached. Magnets in the label are sensed by the infusion pump so that it knows the scales and drug information. This device still requires patient specific programming that must be performed at the infusion pump.

The infusion device of U.S. Pat. No. 5,256,157 to Samiotes et al. describes an infusion device that uses replaceable memory modules to configure non-patient specific parameters such as patient controlled analgesia, patient controlled analgesia with a continuous infusion, et cetera. The patient specific programming must then be performed by the user. These replaceable modules do not display either the non-patient specific parameters or the patient specific parameters. Displaying these parameters electronically on the infusion pump requires an increase in cost in the pump and complexity to the operator.

SUMMARY OF THE INVENTION

An infusion pump configured to pump fluid through a flexible tubing is provided. The infusion pump includes an armature configured to compress the tubing when in a first position and uncompress the tubing when in a second position; a permanent magnet providing an attractive force that moves the armature to the first position to compress the tubing; and an electronic device configured to overcome the attractive force of the permanent magnet and uncompress the tubing by moving the armature from the first position to the second position.

Also provided is a method of operating an infusion pump, where the infusion pump includes an armature configured to compress and uncompress infusion tubing, and where a permanent magnet provides an attractive force that moves the armature to compress the tubing. The method includes activating an electronic device that overcomes the attractive force of the permanent magnet and moves the armature to uncompress the infusion tubing; and deactivating the electronic device, where the deactivation allows the attractive force of the permanent magnet to compress the infusion tubing.

An infusion pump is also provided, the infusion pump including an armature configured to compress an infusion tube when in a first position and uncompress the tube when in a second position; a permanent magnet providing an attractive force that moves the armature to the first position to compress the tube; means for activating an electronic device that overcomes the attractive force of the permanent magnet and moves the armature to uncompress the infusion tube; and means for deactivating the electronic device, where the deactivation allows the attractive force of the permanent magnet to compress the infusion tube. In one embodiment, the means for activating includes a control module configured to activate an electromagnet. In another embodiment, the means for deactivating includes a control module configured to deactivate an electromagnet.

DETAILED DESCRIPTION

Figure 1:
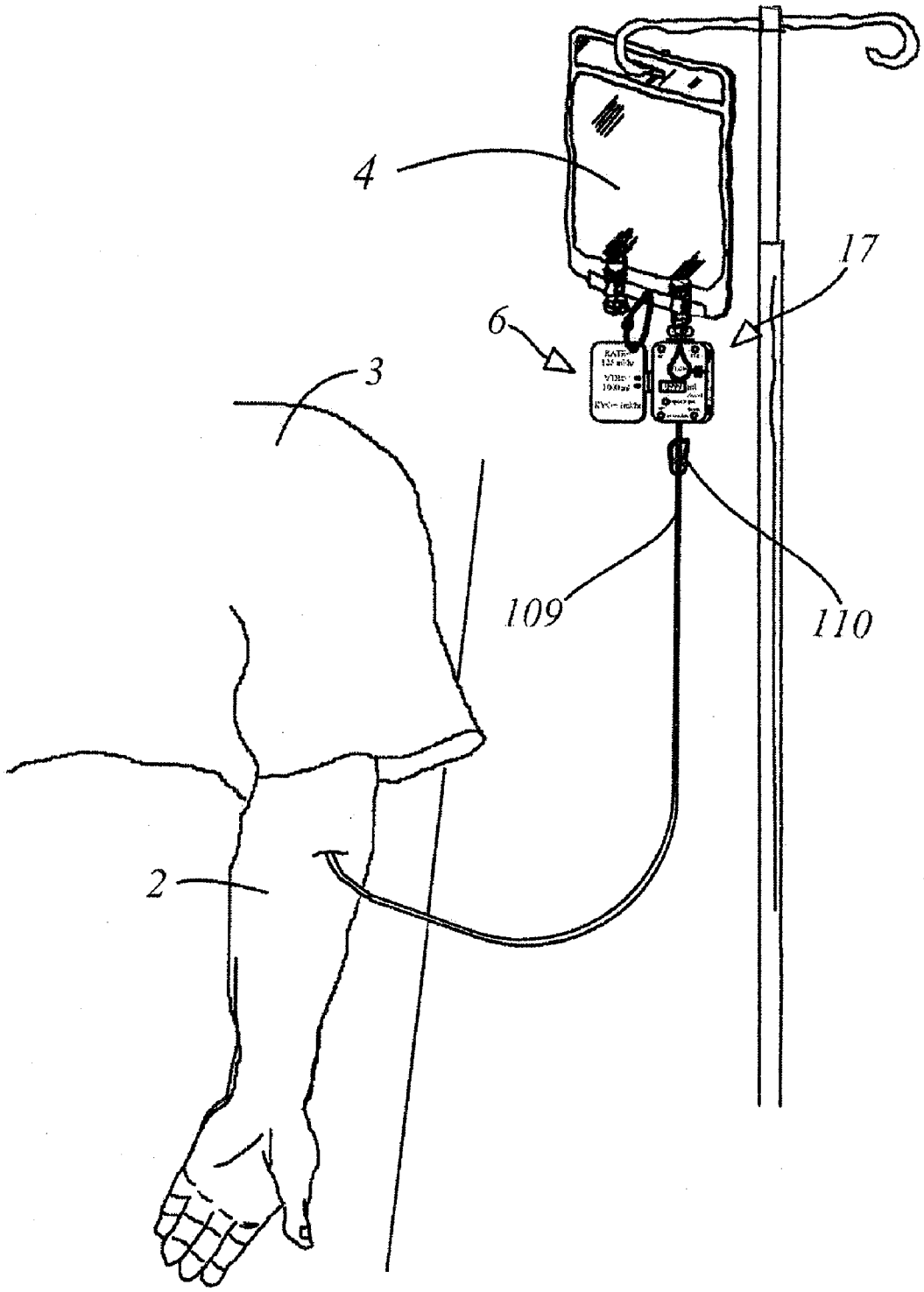
FIG. 1 is a view of an embodiment of a pump in operation.

Any feature or combination of features described herein are included within the scope of the present invention provided that the features included in any such combination are not mutually inconsistent as will be apparent from the context, this description, and the knowledge of one skilled in the art. In addition, any feature or combination of features may be specifically excluded from any embodiment of the present invention. For purposes of summarizing the present invention, certain aspects, advantages and novel features of the present invention are described herein. Of course, it is to be understood that not necessarily all such aspects, advantages or features will be embodied in any particular embodiment of the present invention.

In reference to the disclosure herein, for purposes of convenience and clarity only, directional terms, such as top, bottom, left, right, up, down, upper, lower, over, above, below, beneath, rear, and front, may be used. Such directional terms should not be construed to limit the scope of the invention in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the invention.

Pumping System

Embodiments of the invention provide an energy efficient pumping mechanism. In one embodiment, a magnet arrangement reduces the required pumping forces and stores energy for later use by the mechanism.

As will be described in more detail below, in one embodiment an electromagnet is used to compress tubing which leads to movement of liquid within the tubing. By actuating the electromagnets, an armature compresses the tubing. In one embodiment, other electromagnets control closing the tubing downstream and upstream of the armature so that the flow of fluid into a particular direction can be controlled. In addition, in another embodiment, the compression force exerted by the electromagnets is stored in the tubing and then recovered as the tubing returns to its original state. In one embodiment the tubing is part of an infusion system for delivering medicine to a patient and the electromagnet is part of an infusion pump.

In another embodiment, magnets mounted on a rocker arm and on the armature force an upstream "pincher" and the armature closed when their associated electromagnets are de-energized. When power is lost to the device, the electromagnets lose magnetic energy which results in the armature and pincher preventing fluid flow through the tubing. This results in a default safe condition in the event that power to the system is interrupted. In representative embodiments, the closed pincher and armature protect against free flow of fluid to the patient.

In yet another embodiment, the device comprises a pivoting armature arrangement that is configured to reduce the magnetic force required to compress the tubing. In this embodiment, the compressing force that is necessary to compress the tubing is shared between a pivoting hinge and the magnet. This reduction in the required magnet force results in a reduction in force that need be supplied by the armature electromagnet.

Occlusion Detection and Flow Monitoring System

Implementations of the present invention also include a pump that comprises a mechanism for detecting occlusions in the tubing. In one embodiment, the pump itself is part of the upstream and downstream occlusion detection system. The pump tubing may be used to help push open the armature during the tubing opening fill stroke. If an upstream occlusion occurs during the fill cycle, then the resulting negative pressure in the tubing will reduce the tubing force on the armature and not allow the armature to complete its opening stroke. A sensor may be provided to sense the armature has not completed its opening stroke. An occlusion control module that is linked to the sensor and monitors the position of the armature may then activate, indicating an upstream occlusion.

In the pumping stroke, the armature closes the tubing. In the event that a downstream occlusion occurs, the resulting increased pressure in the tubing may increase the tubing force on the armature and prevent the armature from compressing the tubing in a predetermined time period. In that case, the armature will not properly complete its delivery stroke. A sensor may be supplied to sense the armature has not completed its delivery stroke, and an occlusion control module linked to the sensor may output an alarm signal, indicating a downstream occlusion.

In a representative embodiment of the invention, the force on the pump tubing is minimized. Larger forces on the tubing result in less tubing life and can lead to permanent deformation of the tubing or, more seriously, to the introduction of particulate pieces of the tubing into the medicament which can be infused into the patient. The magnet configuration can result in a force that constrains the tubing to a specific gap. The armature may actually be limited by the dimension of the magnet itself. This insures that the optimum magnetic force is applied when the gap is zero.

In another representative embodiment of the invention, the occlusion control module not only indicates the presence of upstream and downstream occlusions, but also functions as a fluid flow monitor. The absence of transitions of the armature from open to closed states can indicate improper fluid flow. The presence of transitions from open to closed states can indicate that a specific amount of fluid (one stroke volume amount) has been infused. Accordingly, the system can determine whether or not fluid is flowing though the tube by monitoring the transition states of the armature that is compressing the tubing. In addition, by storing and analyzing the transition states over time, the system can determine how much liquid is flowing through the tubing by knowing the fluid flow per stroke and multiplying that number by the number of strokes of the armature.

In a representative embodiment, the magnetic flux developed by the electromagnet does not travel through the other magnets. Including the other magnets in the flux path of the electromagnet may reduce the amount of flux available to develop the force required to move the armature to the open position, and result in an increase in the cost and size of the electromagnet. Finally, the flux generated by the electromagnet may be configured to travel only through a single gap in an exemplary embodiment of the present invention.

Representative Features of an Infusion Pump

A representative embodiment of the present invention will now be described with reference to FIG. 1, illustrating an embodiment of a pump in operation. A fluid reservoir 4 is shown containing a medicament to be infused into the arm 2 of a patient 3. Infusion pump 17 is shown attached to reservoir 4. Medicament flows into the pump 17, then out of the pump, past an optional flow clamp 110 and through exit tubing 109 to the patient 3. The infusion pump can be accompanied by a programming device 6 to monitor and control the flow of medicament to the patient. In some embodiments, the programming device is a programming module.

Figure 2:
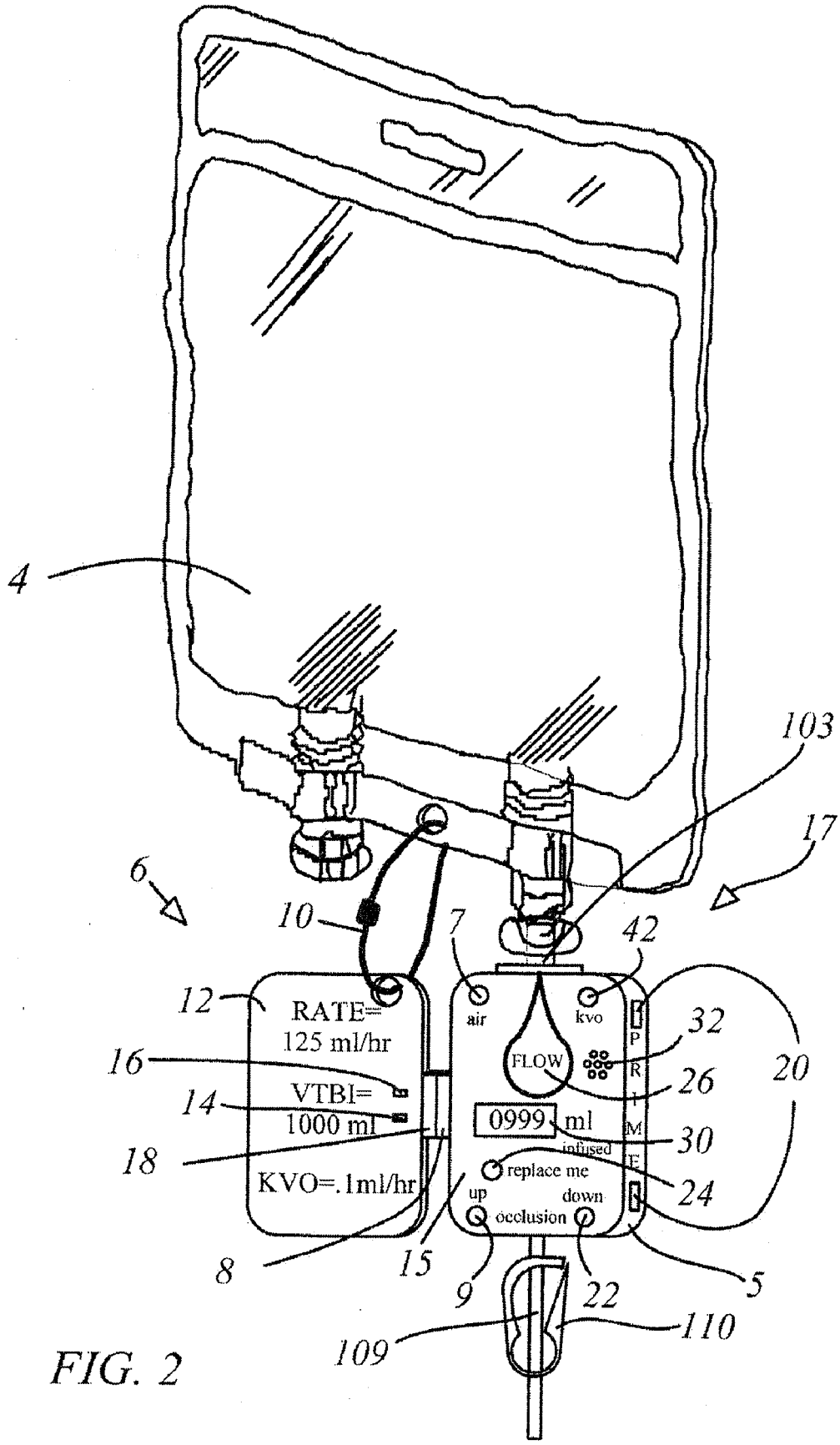
FIG. 2 is an enlarged view of the pump of FIG. 1.

Illustrating the pump of FIG. 1 in greater detail, FIG. 2 shows infusion pump 17 attached to fluid reservoir 4 through its reservoir spike 103 through which medicament may flow into pump 17. Programming device 6 may be attached to the infusion pump through programming connector 8 which provides an electrical connection between the infusion pump 17 and the programming device 6. To minimize infusion errors, the programming device may also be attached to reservoir 4 through a locking tamper evident tie 10. In alternate embodiments, the programming device may be made part of the fluid reservoir or wired directly to and made part of the infusion pump. In one embodiment where the programming device is made part of the fluid reservoir, a fluid reservoir such as but not limited to an intravenous (IV) bag contains a programming module which can be linked to infusion pump 17 through an electronic connection. The programming module can include, for example, an electronic chip that is attached to the IV bag and contains dosing parameters. The programming module can contain any suitable programming parameter, such as but not limited to infusion rate and duration. In another embodiment, a user can insert the electronic chip into infusion pump 17 to program pump 17.

Programming device 6 may be configured to control pump programming information such as, but not limited to, infusion rate, volume to be infused, and keep vein open rate. The programming device 6 displays programming information for the user of the device. Such programming information could include, for example, limits on time of infusion to ensure that time sensitive infusions would not be delivered late or at inappropriate times. The programming device may optionally contain status or history information retrieved from the pump, such as infusion complete, volume infused amount, alarm history, et cetera that may later be downloaded for user access. The device may have a tamper resistant lock for patient safety.

Attaching the programming device 6 to the pump 17 can cause the pump to be automatically programmed to the desired infusion parameters or may cause the pump to automatically prime the fluid path with a specific volume of fluid to remove air in the tubing. Alternatively, the pump 17 may have tamper resistant switches that allow the user to prime the fluid path. The pump exit tubing 109 may include the clamp 110 to allow the user to start and stop the infusion. Closing the clamp could stop the infusion and cause a downstream occlusion alarm and display. Reopening the clamp could cause the infusion to resume. The infusion pump is configured in one embodiment to measure the time required to infuse an increment of fluid at a given infusion rate and produce a display of information that allows a user to observe how much resistance the fluid is encountering and take steps necessary to accommodate the restriction. For example, the user may raise or lower the fluid reservoir 4 to increase or decrease the fluid pressure or replace a partially obstructed catheter on the patient. A control module, a measurement module, or any other suitable electronic device can measure the time required to infuse the increment of fluid.

A display 15 on the infusion pump can indicate the amount of volume infused or any alarm conditions present. For example, a display 26 resembling a fluid drop can be programmed to flash at a rate proportional to the actual infusion rate to emulate a standard infusion set drip chamber. The flashing display 26 could change in color or size or brightness depending on the fluid resistance encountered.

The infusion pump may have the ability to purge air that has entered the pump tubing by collapsing the tubing while the downstream pincher is closed, thereby forcing the air back into the fluid reservoir. Reopening the tubing with the same pincher closed could refill the tubing with fluid absent of air.

In another embodiment, the programming device can include a memory device such as an EEPROM (Electrically Erasable Programmable Read-Only Memory). The device could be programmed with the desired programming information and include a check sum or CRC (Cyclic Redundancy Code) that could be compared to a value calculated by representative embodiments of the invention after downloading the programming parameters. Methods to calculate these codes are well known in the industry.

Other arrangements may also be desirable such as locating a power source or control module on the programming device. The volume infused indicator may also be optionally located on the programming device. Alternatively, the programming device or parts of it may be incorporated into representative embodiments of the invention. Additionally, the device may have a rechargeable power system that could be recharged from a wall outlet or other power source.

As illustrated with continued reference to FIG. 2, a representative programming device 6 includes infusion parameter display 12, infusion parameter recall device 14, infusion parameter testing device 16, and optional programming device connector 18. In some embodiments, these devices enable infusion pump 17 to test and recall infusion parameters.

Infusion pump 17 optionally includes enclosure 5, display 15, speaker 32, and priming switches 20. The display may include indicators, such as air alarm indicator 7, up occlusion indicator 9, down occlusion indicator 22, replace me indicator 24, flow indicator 26, Keep Vein Open (KVO) indicator 42, and optional volume infused indicator 30. The KVO indicator 42 indicates that the infusion is complete and the device is pumping at a minimal rate to keep the vein open.

Figure 3:
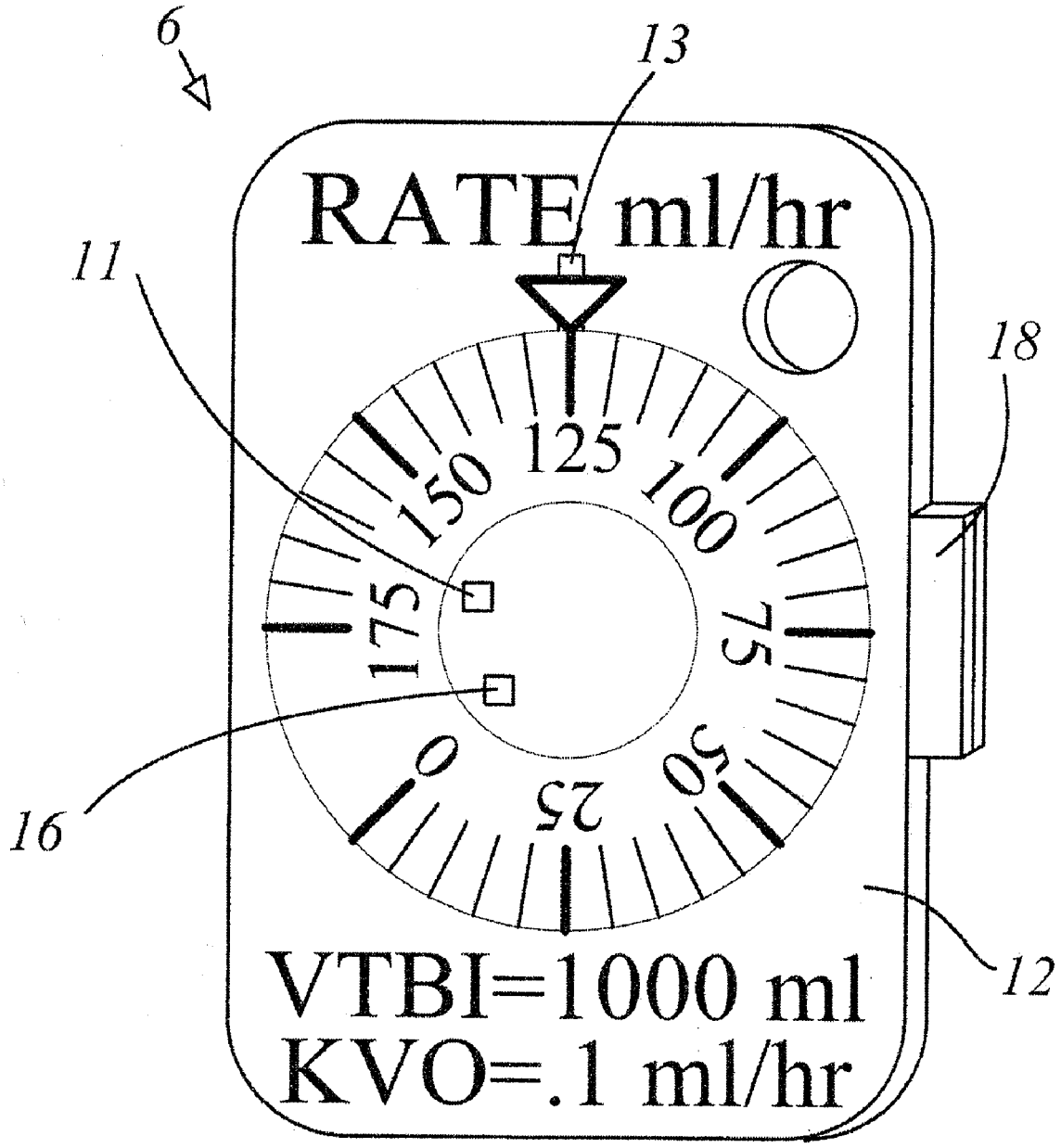
FIG. 3 is a view of an embodiment of a programming device.

FIG. 3 shows another embodiment of a programming device 6 that allows users to select and display programming parameters. The programming device may include such features as an infusion parameter selector 11, a tamper resistant infusion parameter selector lock 13, infusion parameter display 12, infusion parameter testing device 16, and programming device connector 18.

Figure 4:
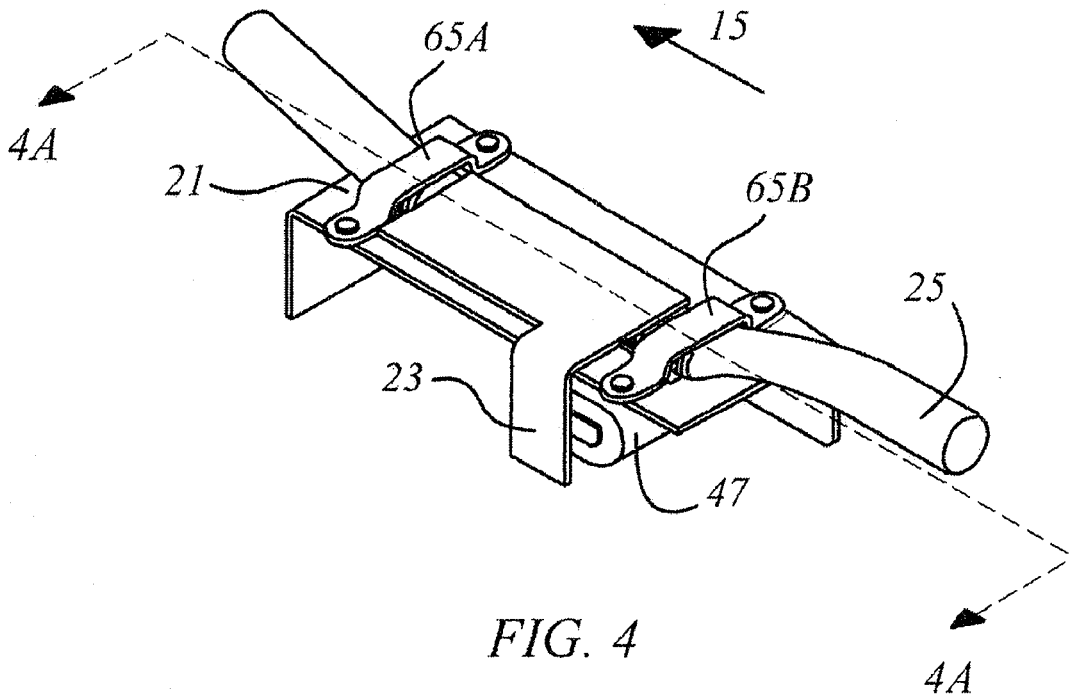
FIG. 4 is a perspective view of another embodiment of a pump.
Figure 4A:
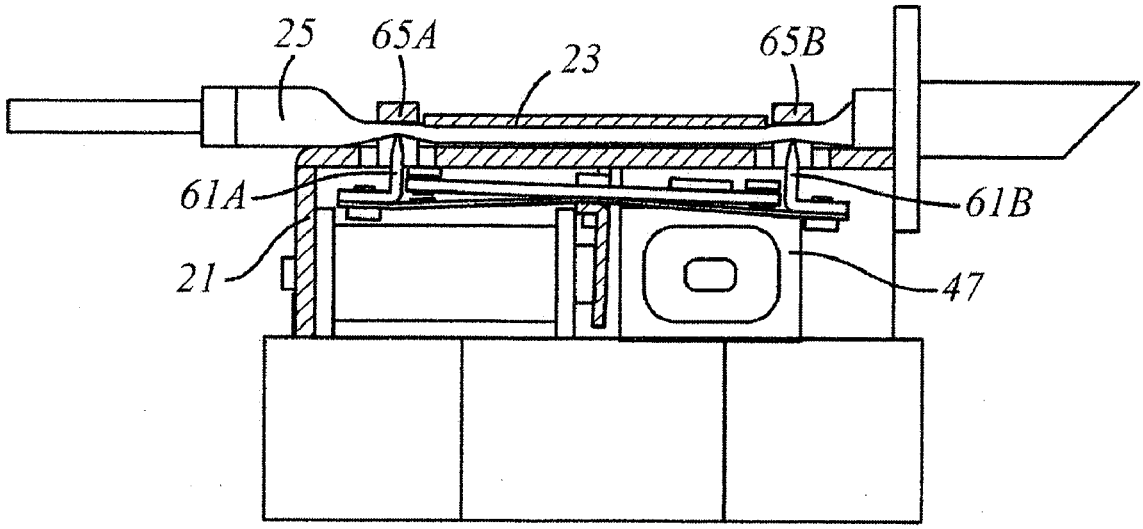
FIG. 4A is a sectional view of the pump of FIG. 4 taken along line 4A-4A.

Another embodiment of the present invention will now be described with reference to FIGS. 4 and 4A. FIG. 4, a perspective view of infusion pump 17, shows tubing 25 on pump frame 21 and passing under armature 23. The direction of fluid flow from a fluid reservoir 4 (not shown), through the pump, and to the patient is indicated by arrow 15. FIG. 4A, a cross-section of pump 17 taken along line 4A in FIG. 4, illustrates downstream pincher 61A and upstream pincher 61B provided under tubing 25. In representative embodiments, downstream pincher 61A and upstream pincher 61B push tubing 25 against downstream detent 65A and upstream detent 65B. Through the application or removal of magnetic forces provided in one embodiment, downstream pincher 61A pushes tubing 25 against detent 65A, while upstream pincher 61B does not push tubing 25 against detent 65B. Referring again to FIG. 4, armature 23 is next rotated by the application of magnetic force supplied by armature electromagnet 47, such that armature 23 is raised up, thereby uncompressing and/or releasing tubing 25. In this state, fluid flows through tubing 25 up to the area of tubing pinched by the downstream pincher 61A.

Again through the application or removal of magnetic forces, upstream pincher 61B then pushes tubing 25 against detent 65B and downstream pincher 61A releases from the tubing 25 to allow fluid to flow in a downstream direction. Armature 23 is next brought down on tubing 25 by magnetic force supplied by magnets (not shown) provided on pump frame 21. With this step, the volume of fluid in tubing 25 in the areas between the upstream and downstream pinchers is forced in the direction indicated by arrow 15, to be infused into the patient. To begin another infusion cycle, magnetic forces are again applied or removed to downstream and upstream pinchers 61A, 61B to allow fluid to flow through tubing 25 up to the area of tubing pinched by downstream pincher 61A. The steps described above are repeated with each infusion cycle.

The representative embodiment of the invention illustrated in FIG. 4 can administer fluid at a precise rate. Pump 17 may be extremely small, lightweight, and power efficient. In a representative embodiment of the invention, the infusion pump is a disposable device intended for a single use or perhaps for a single patient use. The invention, however, is not limited to a disposable device and other embodiments may allow parts of the device to be disposable and replaceable and other parts to be used multiple times.

Features of a representative embodiment of the invention will now be described with reference to FIG. 5, which illustrates a top view of infusion pump 17. As shown, tubing 25 rests on pump frame 21. Armature 23 is shown pivoting on pump frame 21 and in contact with pump tubing 25. Magnets 43A and 43B are also located on pump frame 21. A magnet cover 27 may optionally be provided to hold magnets 43A and 43B in place on pump frame 21. Flow sensor post 31 of a flow sensor, discussed in more detail with reference to FIG. 6 below, is attached to pump frame 21.

Pump tubing 25 passes under both upstream pincher detent 65B and downstream pincher detent 65A. The upstream end of pump tubing 25 is attached to air detector 99. Air detector 99 is attached to medication reservoir piercing spike 103 which is attached to pump frame 21. The downstream end of pump tubing 25 is attached to optional flow controlling orifice 107. Flow controlling orifice 107 is connected to exit tubing 109.

Pump frame 21 is made of any suitable material, such as formed cold rolled steel. Upstream pincher detent 65B is formed on pump frame 21 adjacent pincher slots 67C and 67D. Downstream pincher detent 65A is also formed on pump frame 21 adjacent pincher slots 67A and 67B and rocker pivot slots 91A and 91B.

Armature sensor arm 73 extends from armature 23. Armature 23 may be made of any suitable material such as cold rolled steel. Upstream armature pivot arm 71B extends from the right side of armature 23 and downstream armature pivot arm 71A extends from the left side of armature 23. Magnet cover 27 is attached to frame 21 by magnet cover screws 41A and 41B. Magnet cover 27 may be made of any suitable material, such as cold rolled steel, while magnet cover screws may be made of brass, for example. Tubing full contactor 29 is disposed on flow sensor post 31 and retained by tubing full contactor upper nut 33.

A partial exploded view of a flow sensor of one embodiment of the present invention is described with reference to FIG. 6. In some embodiments, the flow sensor is an occlusion detector. Flow sensor post 31 extends through frame 21 and is retained by flow sensor post lock nut 38. Tubing empty contactor 35 is disposed on flow sensor post 31 and retained by tubing empty contactor lower nut 39 and tubing empty contactor upper nut 37. Tubing empty contactor contact 36 is attached to the upper side of tubing empty contactor 35. Tubing full contactor 29 is disposed on flow sensor post 31 and retained by tubing full contactor lower nut 34 and tubing full contactor upper nut 33. Tubing full contactor contact 28 is attached to the lower side of tubing full contactor 29. Armature sensor arm tubing full contact 75 is attached to the upper side of armature sensor arm 73. Armature sensor arm tubing empty contact 77 is attached to the lower side of armature sensor arm 73.

Figure 7A:
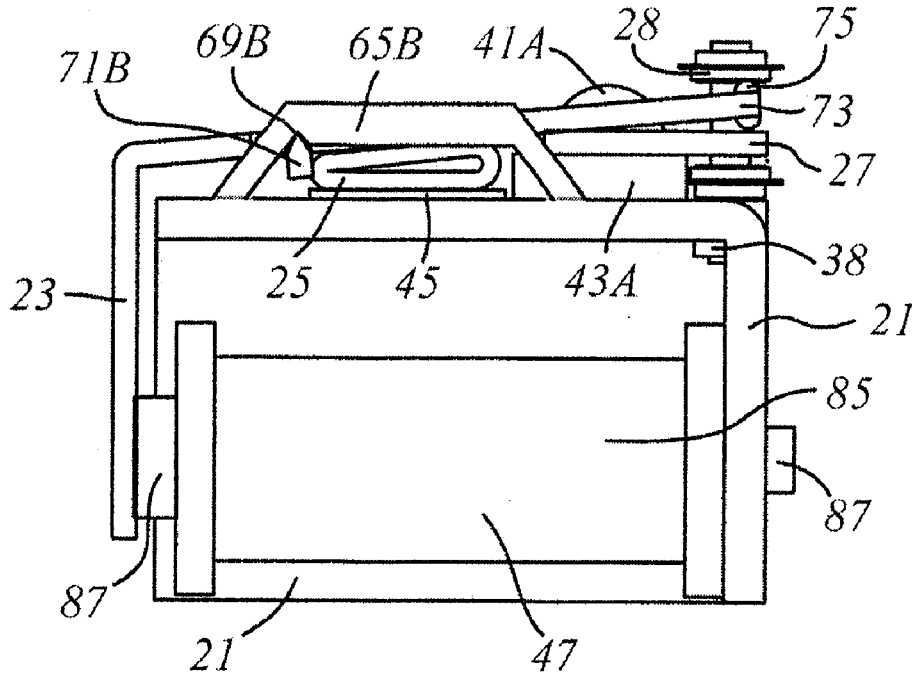
FIG. 7A is a side view of the pump of FIG. 5 at the completion of the fill stroke.

FIG. 7A is a cross-sectional end view of a representative embodiment of the present invention. Magnet cover screw 41A, magnet cover 27, and upstream magnet 43A are formed on frame 21. Flow sensor post lock nut 38 is also provided on frame 21. Armnature 23 is shown in the tubing full position, with armature 23 in contact with armature magnet core 87. Armature sensor arm tubing full contact 75 is formed on armature sensor arm 73. Armature sensor arm tubing full contact 75 is shown contacting tubing full contactor contact 28. A cross-section of tubing 25 in the "full" state is shown resting on tubing shim 45. Armature electromagnet 47 is attached to pump frame 21 at armature magnet mounting slot 95 (not shown) by armature magnet core 87. Armature magnet coil 85 is shown surrounding armature magnet core 87. Armature magnet core 87 may be made of any suitable material, such as cold rolled steel.

Downstream armature pivot slot 69A (not shown) is formed on downstream pincher detent 65A (not shown). Similarly, upstream armature pivot slot 69B is formed on upstream pincher detent 65B. Downstream armature pivot arm 71A (not shown) may be disposed in downstream armature pivot slot 69A (not shown) and upstream armature pivot arm 71B may be disposed in upstream armature pivot slot 69B.

Figure 7B:
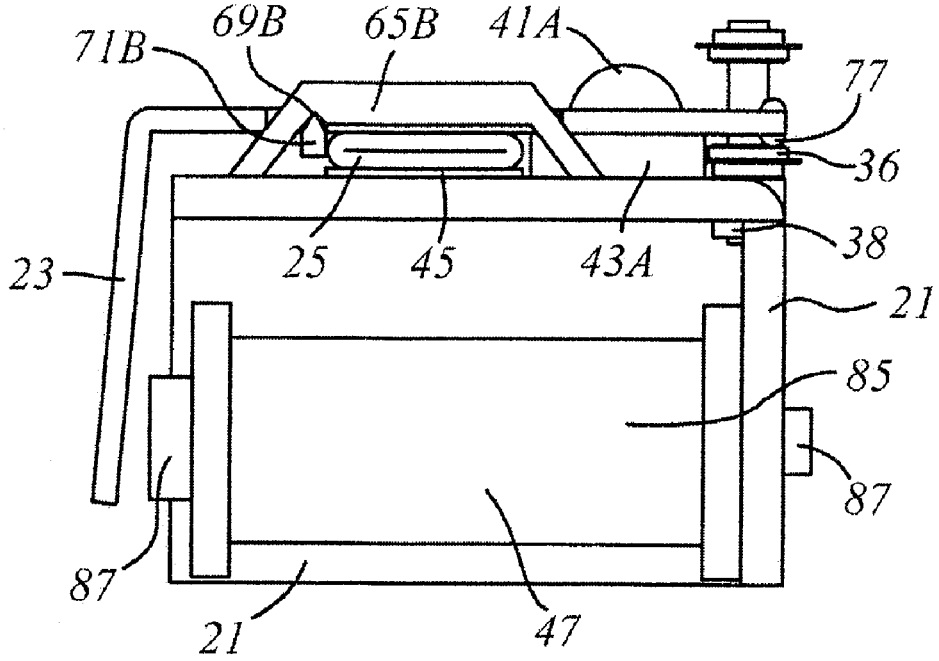
FIG. 7B is a side view of the pump of FIG. 5 at the completion of the pump stroke.

FIG. 7B is a cross-sectional view of an embodiment of the present invention. Armature 23 is shown in the tubing empty position, with a cross-section of tubing 25 illustrated in the "empty" state. Armature sensor arm tubing empty contact 77 is shown contacting tubing empty contactor contact 36.

Figure 8:
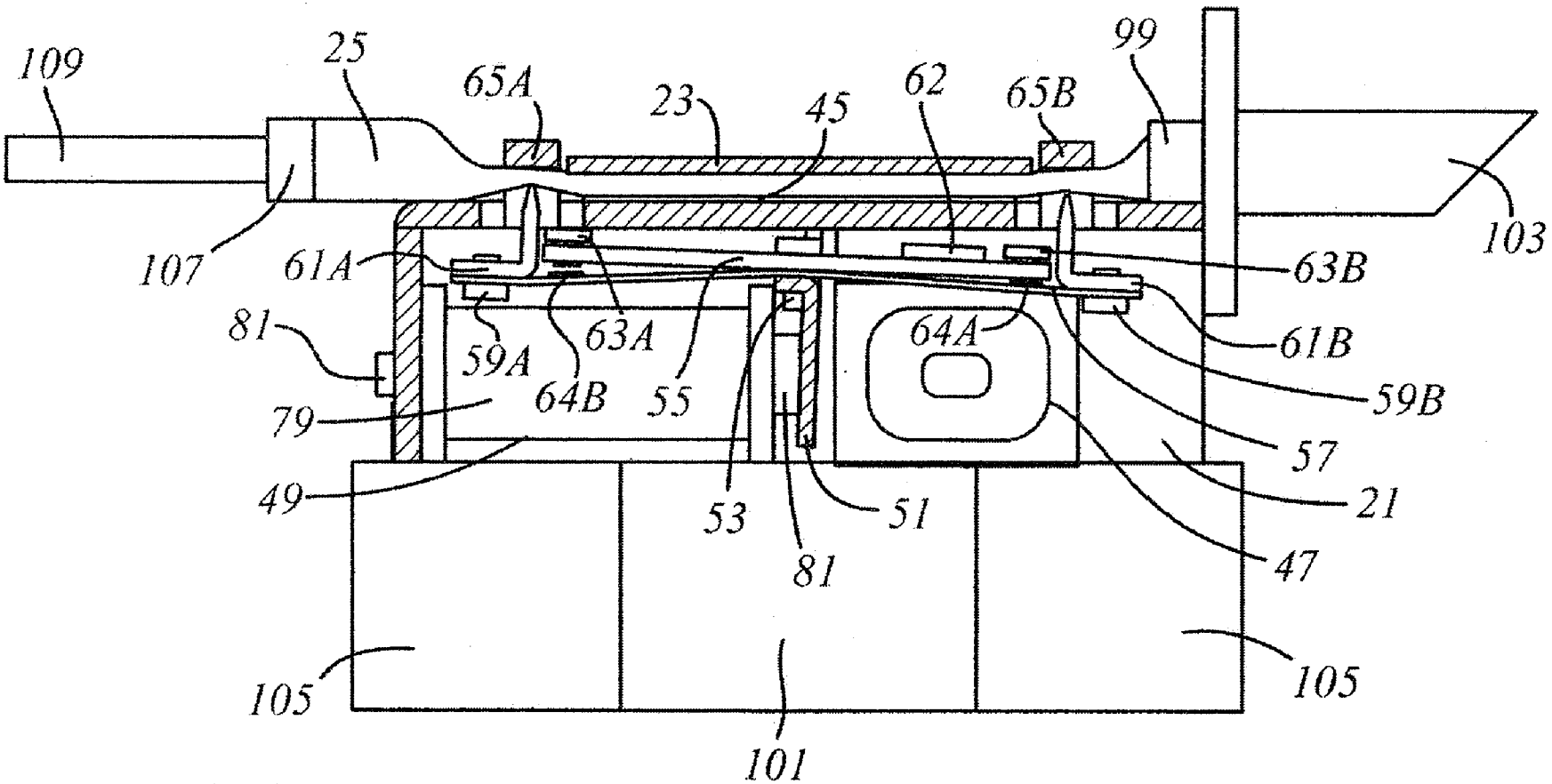
FIG. 8 is a sectional view of the pump of FIG. 5 showing pinchers during the fill stroke.

FIG. 8 is a cross-sectional side view of a representative embodiment of infusion pump 17 during the fill stroke. Cross-sections of armature 23, pump frame 21, and rocker support 51 are shown. Pincher electromagnet 49 is attached to pump frame 21 at pincher magnet mounting slot 97 (not shown) by pincher magnet core 81. Pincher magnet coil 79 is shown surrounding pincher magnet core 81. Rocker support 51 is shown contacting pincher magnet core 81. Pincher magnet core 81 may be made of any suitable material, such as cold rolled steel. Rocker 55 is attached to rocker leaf spring 57 and rocker support 51 by rocker support screw 53. Rocker support pivot arms 93A and 93B (not shown) are formed from the rocker support 51 and pivot, respectively, in the rocker pivot slots 91A and 91B (not shown) on frame 21. Downstream leaf spring pre-load screw 63A and upstream leaf spring pre-load screw 63B are attached to rocker 55. An upstream sensor, upstream contact switch 64A, is attached to rocker leaf spring 57 and fits between leaf spring 57 and the upstream leaf spring pre-load screw 63B. A downstream sensor, downstream contact switch 64B, is attached to rocker leaf spring 57 and fits between leaf spring 57 and the downstream leaf spring pre-load screw 63A. Rocker magnet 62 is attached to rocker 55. It will be understood by persons of skill in the art that rocker magnet 62 can be positioned in various locations, and is not limited to a location on the rocker.

With continued reference to FIG. 8, downstream pincher 61A is attached to leaf spring 57 by downstream pincher retention screw 59A and contacts tubing 25. Upstream pincher 61B is attached to leaf spring 57 by upstream pincher retention screw 59B and contacts tubing 25. Leaf spring 57 may be made of any suitable material, such as spring steel. Power source 105 and control module 101 are optionally attached to pump frame 21.

Figure 9:
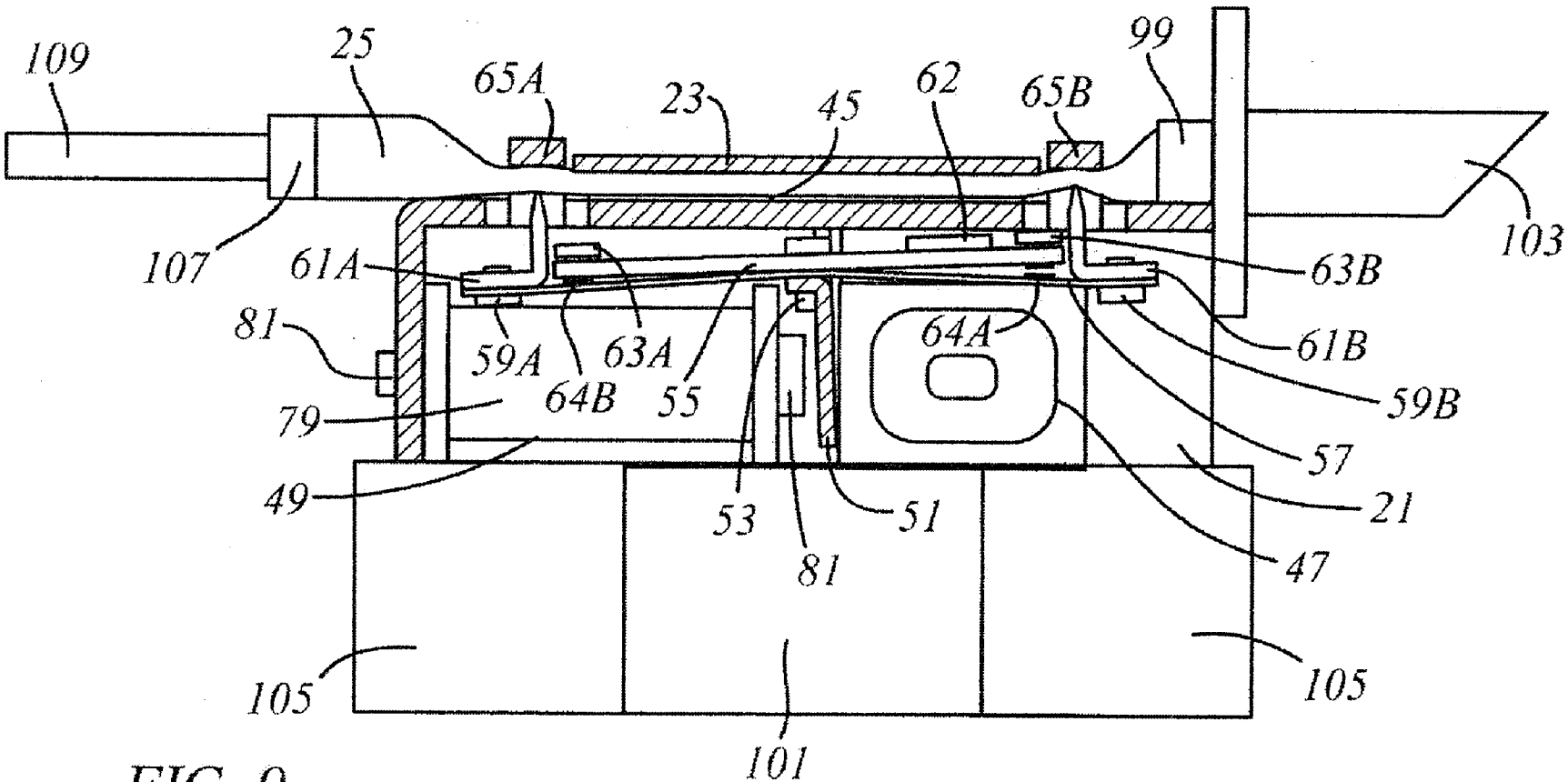
FIG. 9 is a sectional view of the pump of FIG. 5 showing pinchers during the pump stroke.

FIG. 9 is another cross-sectional side view of a representative embodiment of infusion pump 17, illustrating the position of downstream pincher 61A and upstream pincher 61B during the pump stage. Rocker support 51 is shown not contacting pincher magnet core 81.

Operation of an Infusion Pump

Figure 10:
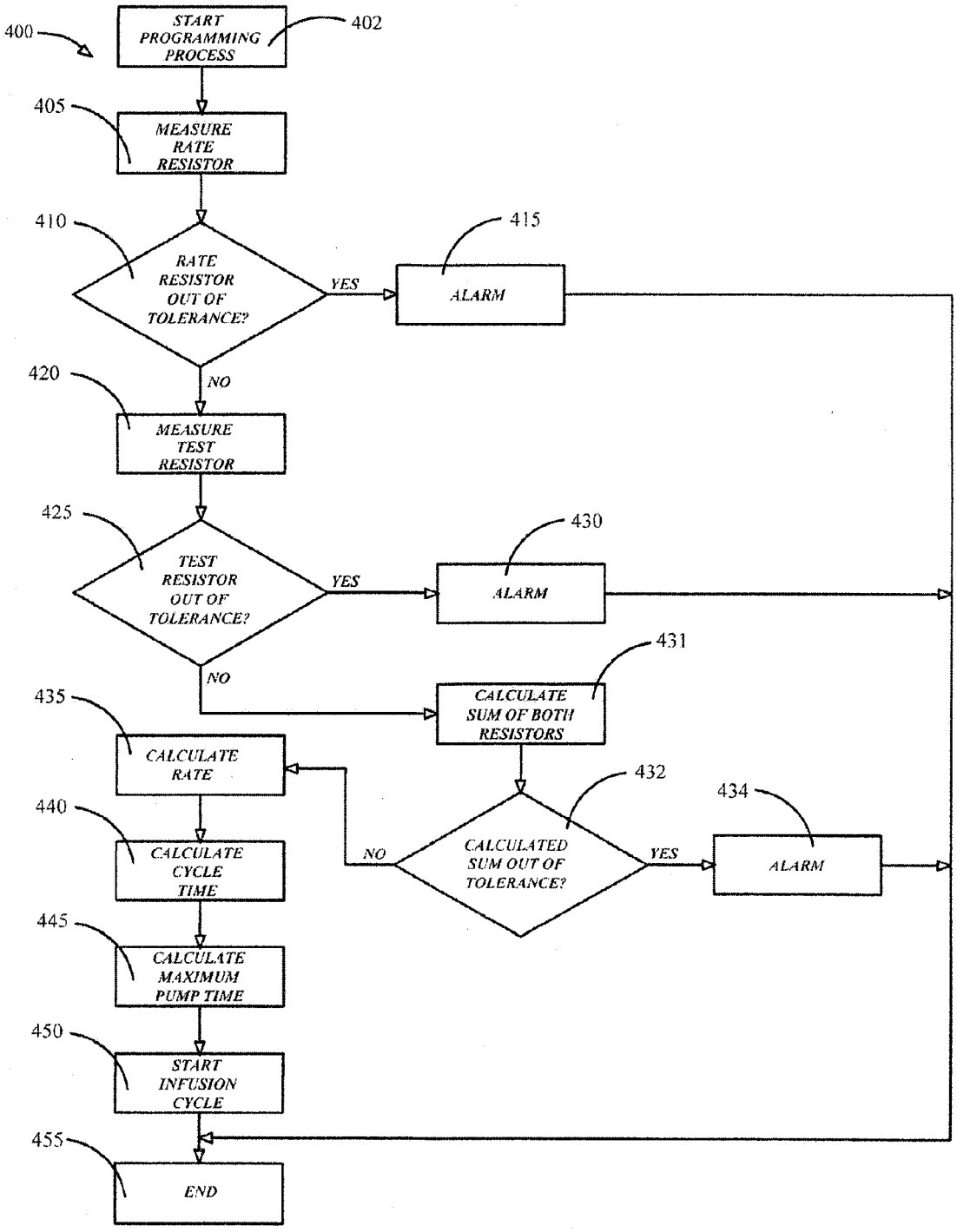
FIG. 10 is a flow chart of one programming process of the pump of FIG. 5 using a resistive programming device.

The programming flow chart of FIG. 10 shows a programming process 400 that could be used with a resistive type programming device, such as programming device 6. Plugging the programming device into the infusion pump starts the programming process at state 402. At state 405, the infusion parameter rate resistor 14 is measured. The measured value is then tested at decision state 410 for the appropriate tolerance. If the value is out of tolerance, then the process moves to a state 415 wherein an alarm is generated. If the resistance is determined to be within tolerance, then the process 400 moves to state 420 wherein a test resistor is measured. The infusion parameter test resistor 16 is then tested at decision state 425 for the appropriate tolerance. If the test resistor is out of tolerance, then the process 400 moves to state 430, wherein an out of tolerance condition results in an alarm being generated. The sum of the values read from the two resistors 14 and 16 is then calculated at state 431, and compared with the fixed known value resistance. If the calculated sum resistance is determined to be out of tolerance at a decision state 432, an alarm is generated at a state 434. If the calculated sum is within tolerance, the process 400 moves to state 435 and the infusion rate is calculated. At state 440, the cycle time is then calculated from the infusion rate and the amount of fluid that is infused in each pump cycle, also known as the stroke volume. The stroke volume can be previously determined during manufacturing. The maximum pump time can then be calculated at state 445, by subtracting the previously determined fill time and pincher switching times from the cycle time. The infusion cycle can then begin at state 450, and the programming process terminates at an end state 455. If an alarm is generated at state 434, the programming process terminates at end state 455.

Methods of measuring resistance are well known. A common method is to charge a capacitor through a known resistance and measure the charge time between two voltage points. The capacitor is then discharged and the same capacitor and voltage trip points are used to measure the charge time through the unknown resistance. The unknown resistor value can then be determined by multiplying the ratio of the charge times by the value of the known resistor. Embodiments of the invention could use this technique or others to accurately measure the value of resistances in the programming device.

One embodiment of a programming device may include two resistors for each programming parameter. One of the resistors could vary directly with the programmed parameter such as 1000 ohms for each ml/hr of infusion rate while the other could decrease 1000 ohms for each ml/hr of infusion rate. The sum of the resistances of the two resistors could be made fixed for all rates at, for example, 500,000 ohms. Each of the resistances of the resistors could be measured by representative embodiments of the infusion pump. The pump could then calculate the sum and verify that it is the fixed value. This would provide the ability to detect a single point failure in either resistor or in the connector and signal an alarm.

Figure 11:
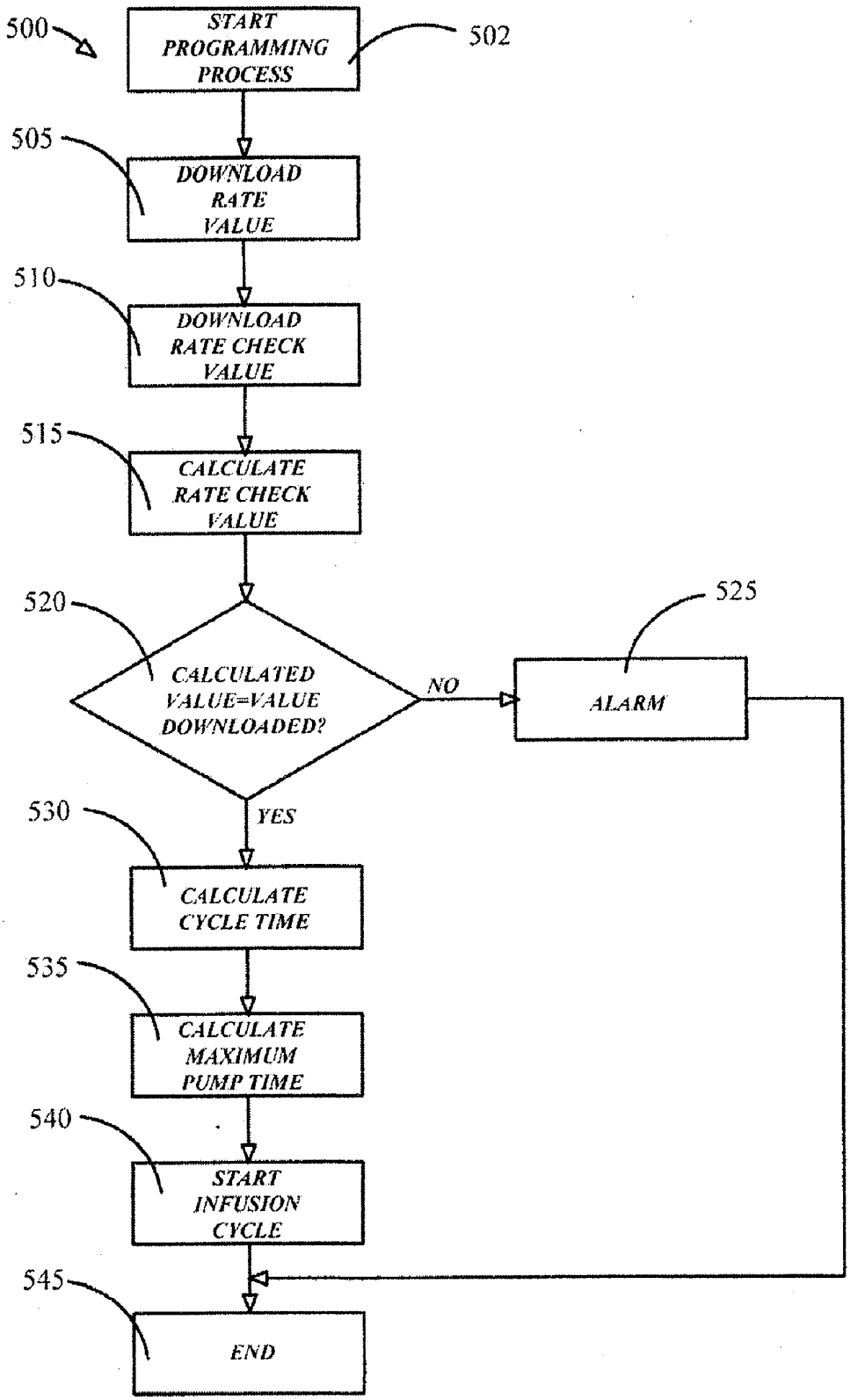
FIG. 11 is a flow chart of another programming process of the pump of FIG. 5 using a memory based programming device.

An alternate programming process 500 is described with reference to the programming flow chart shown in FIG. 11. In this example a memory device such as an EEPROM is used to recall programming parameters. Again, plugging the programming device into the infusion pump starts the programming process at state 502. The rate value is then downloaded from the memory device at state 505. At state 510, the rate check value is downloaded. The infusion pump next calculates what the rate check value should be from the downloaded rate value at state 515. The calculated and downloaded rate check values are then compared at decision state 520. If the values are not equal, an alarm is generated at state 525. If the values are equal, the cycle time is then calculated at step 530 from the rate value and the known stroke volume. As described above with reference to programming process 400, the maximum pump time is then calculated at state 535 from the previously determined fill time and pincher switching times. The infusion cycle can then begin again at state 540, and the programming process is complete at end state 545. If an alarm is generated at state 525, the programming process terminates at end state 545.

An alternative programming device could use switches to select the desired programming parameters. Still another embodiment could use the voltages or currents developed by applying a voltage or current to a network of parameter setting resistors to select the appropriate parameters.

Figure 5:
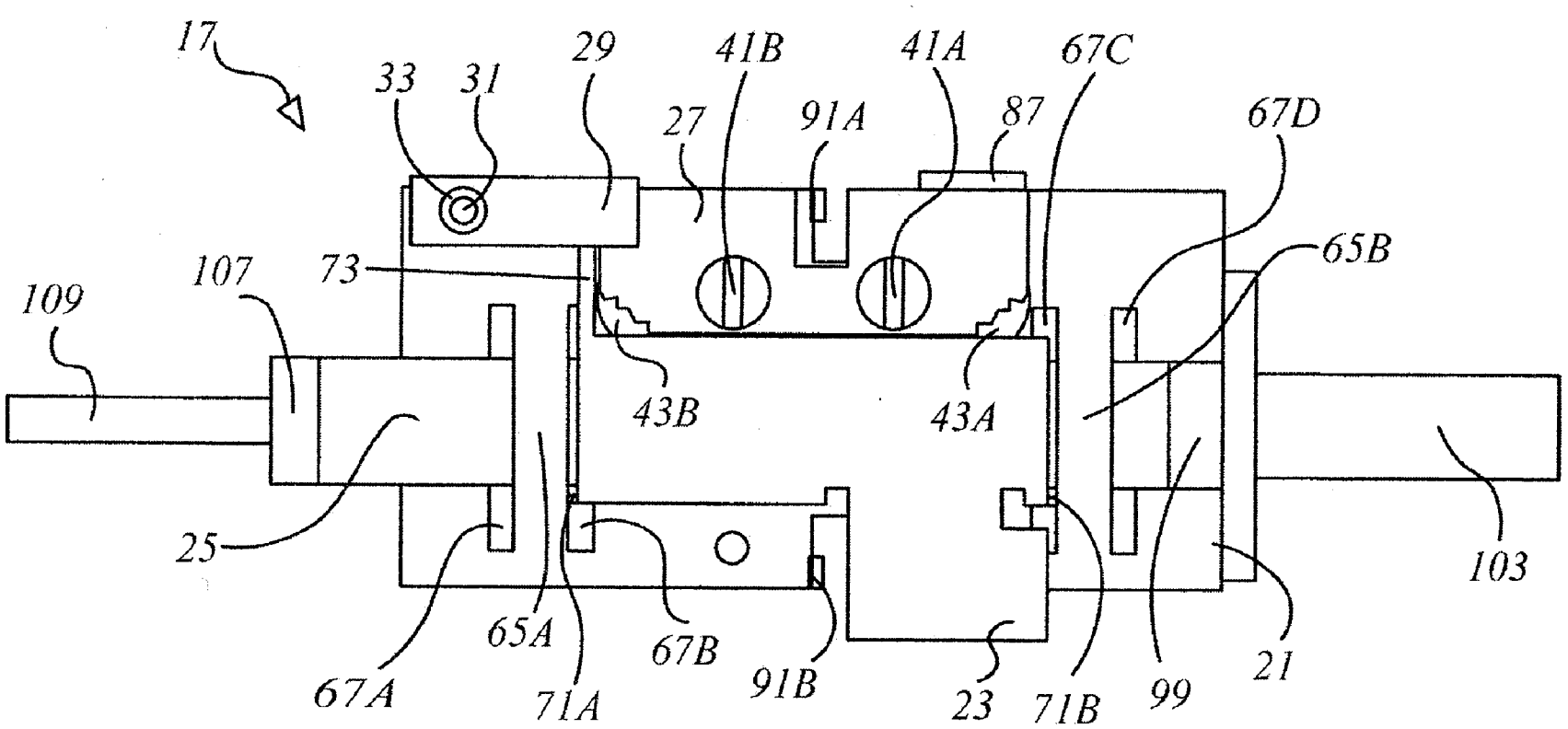
FIG. 5 is a top view of another embodiment of a pump.

Referring now to FIGS. 5 and 8, the infusion pump 17 can include an optional reservoir spike 103 to pierce a fluid reservoir 4 containing medicament to be infused and an air detector 99 to detect the presence of air bubbles in the fluid path. The pump may also include a flow controlling orifice 107, which functions to both limit the peak infusion rate and to provide an additional measure of safety by providing a more precise time interval during which the pump tubing 25 empties its fluid and discharges the fluid through the controlling orifice 107. That time interval is measurable by the control module 101 using the pump stroke process 700 described in greater detail below with reference to FIG. 13. Should an out-of-range time interval be encountered, the appropriate safety measures of shutting down the infusion and/or providing the appropriate warning to the user can be taken.

Figure 12:
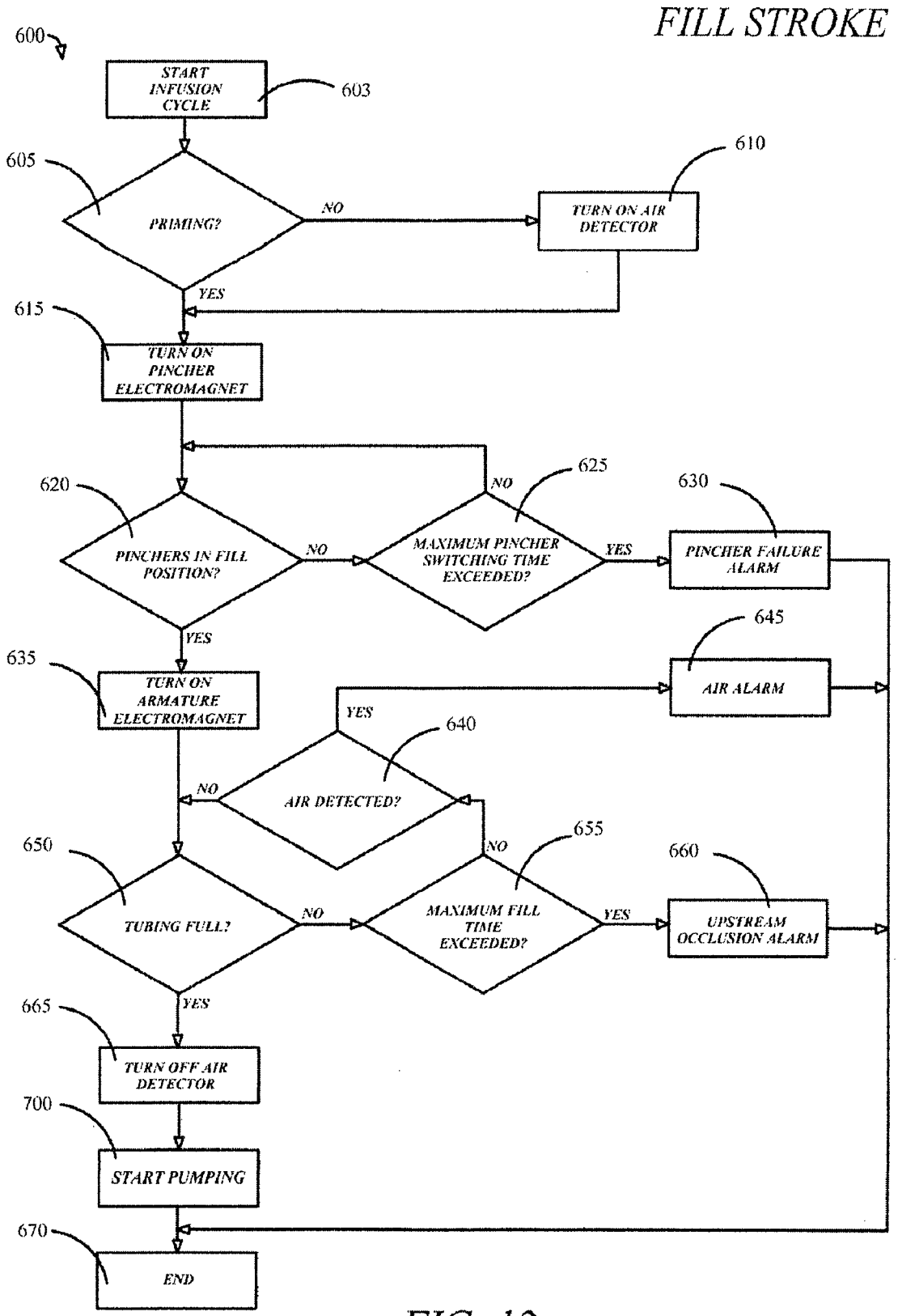
FIG. 12 is a flow chart of a fill stroke process of the pump of FIG. 5.

FIG. 12 describes the fill stroke process 600, which is also described with reference to FIG. 8. The start of the infusion cycle starts at state 603 with the air detector 99, the armature electromagnet 47, and the pincher electromagnet 49 de-energized. Forces from right magnet 43A and left magnet 43B (not shown) draw the armature 23 in contact with their surfaces, in opposition to the opening forces that are generated by the collapsed pump tubing 25. Force from rocker magnet 62 pivots the rocker 55 counterclockwise so as to pivot upstream pincher 61B in order to prevent fluid flow in the tubing. Upstream pincher 61B, attached to the rocker leaf spring 57 by the upstream pincher retention screw 59B, is forced against pump tubing 25 (thereby stopping fluid flow through the tubing) by rocker leaf spring 57. Rocker leaf spring 57 has separated from upstream leaf spring preload screw 63B, since in this position the pump tubing 25 force on the pincher exceeds the opposite rocker leaf spring 57 preload force on the upstream leaf spring preload screw 63B. This opens upstream contact switch 64A and sends a signal to the control module. Thus, when an occlusion occurs, an error in the flow is sensed and an error signal is generated and sent to the control module.

Downstream pincher 61A, which is attached to rocker leaf spring 57 by downstream pincher retention screw 59A, is drawn slightly away from pump tubing 25 (thereby allowing fluid to flow through the tubing) by the counterclockwise pivoting of the rocker 55. Rocker leaf spring 57 is in contact with downstream leaf spring pre-load screw 63A because the force exerted on the downstream pincher 61A by the pump tubing 25 is less than the force exerted on the downstream leaf spring pre-load screw 63A by the rocker leaf spring 57. This closes downstream contact switch 64B and sends a signal to the control module. The control module distinguishes the combination of an open upstream contact switch and a closed downstream contact switch as an indication that the pinchers 61A and 61B are in the pump position.

This state in the infusion cycle is further described with reference to FIG. 7B. Armature sensor arm 73 is in its lowest position since the pump tubing 25 is completely collapsed and the armature is resting against the right magnet 43A and the left magnet 43B. In this position armature sensor arm tubing empty contact 77 is forced against tubing empty contactor contact 36. As shown in FIG. 6, tubing empty contactor contact 36 is connected, such as by welding, to tubing empty contactor 35, which is held in place on flow sensor post 31 by tubing empty contactor upper nut 37 and tubing empty contactor lower nut 39. This contact sends a tubing empty signal to the control module 101 (not shown).

Referring again to the fill stroke process 600 shown in FIG. 12, the control module 101, programmed to wait for an appropriate time interval from the last activation of the pincher electromagnet 49 to accurately deliver fluid at the prescribed rate, now tests if the infusion pump is priming at decision state 605. If the infusion pump is not priming, the air detector is turned on at state 610. If the infusion pump is priming, the air detector remains off. The pincher electromagnet 49 is then activated at state 615. This state in the infusion cycle is further described with reference to FIG. 8. Magnetic flux generated in the pincher magnet core 81 from current flowing in the pincher magnet coil 79 attracts the rocker support 51 toward the core 81. This attractive force causes the rocker 55 to pivot clockwise on pivot arms 69A and 69B in rocker pivot slots 91A and 91B.

This clockwise motion forces rocker leaf spring 57 to push downstream pincher 61A against pump tubing 25 (thereby stopping fluid flow through the tubing). Rocker leaf spring 57 has separated from downstream leaf spring pre-load screw 63A, since in this position the pump tubing 25 force on the pincher 61A exceeds the opposite rocker leaf spring 57 preload force on the downstream leaf spring preload screw 63A. This opens the downstream contact switch and sends a signal to the control module.

Upstream pincher 61B is drawn slightly away from pump tubing 25 (thereby allowing fluid to flow through the tubing) by the clockwise pivoting of the rocker 55. Rocker leaf spring 57 is in contact with upstream leaf spring pre-load screw 63B because the force exerted on the upstream pincher 61B by the pump tubing 25 is less than the force exerted on the upstream leaf spring pre-load screw 63B by the rocker leaf spring 57. This closes the upstream contact switch 64A and sends a signal to the control module. This opening of the pump tubing 25 adjacent the upstream pincher 61B does not occur until the pump tubing 25 adjacent the downstream pincher 61A has closed, thereby stopping backflow of fluid during the transition.

As illustrated with reference to FIG. 8, this position of the rocker 55 is referred to as the "fill" stroke, because the fluid path to the fluid source at reservoir spike 103 has been opened and the fluid path downstream to the optional flow controlling orifice 107 has been closed. The control module distinguishes this position by the signals sent by the closed upstream contact switch 64A and the open downstream contact switch 64B.

At decision state 620, the control module tests for the fill position signals until the maximum pincher switching time has elapsed at decision state 625. If the fill position has not been achieved by this time, a pincher failure alarm occurs at state 630.

The control module 101 now activates the armature electromagnet 47 at state 635. With reference to FIG. 7B, magnetic flux generated in the armature magnet core 87 from current flowing in the armature magnet coil 85 attracts the armature 23 toward armature magnet core 87. This force counteracts the tubing closing forces generated by the right and left magnets and contributes to the pump tubing opening force generated by the tubing itself. If the upstream fluid path is open and no upstream occlusions or vacuums are present, the armature pivots counterclockwise at the upstream armature pivot arm 71B and the downstream armature pivot arm 71A in the downstream armature pivot slot 69A and the upstream armature pivot slot 69B, respectively.

FIG. 7A illustrates the rotated position of the armature. At this point in the pump cycle, armature sensor arm 73 is now raised and fluid has entered the section of pump tubing 25 from the reservoir spike. Pump tubing 25 is shown in its open state filled with one stroke volume of fluid which will be dispensed to the flow controlling orifice during the next pump stroke, described below.

Figure 6:
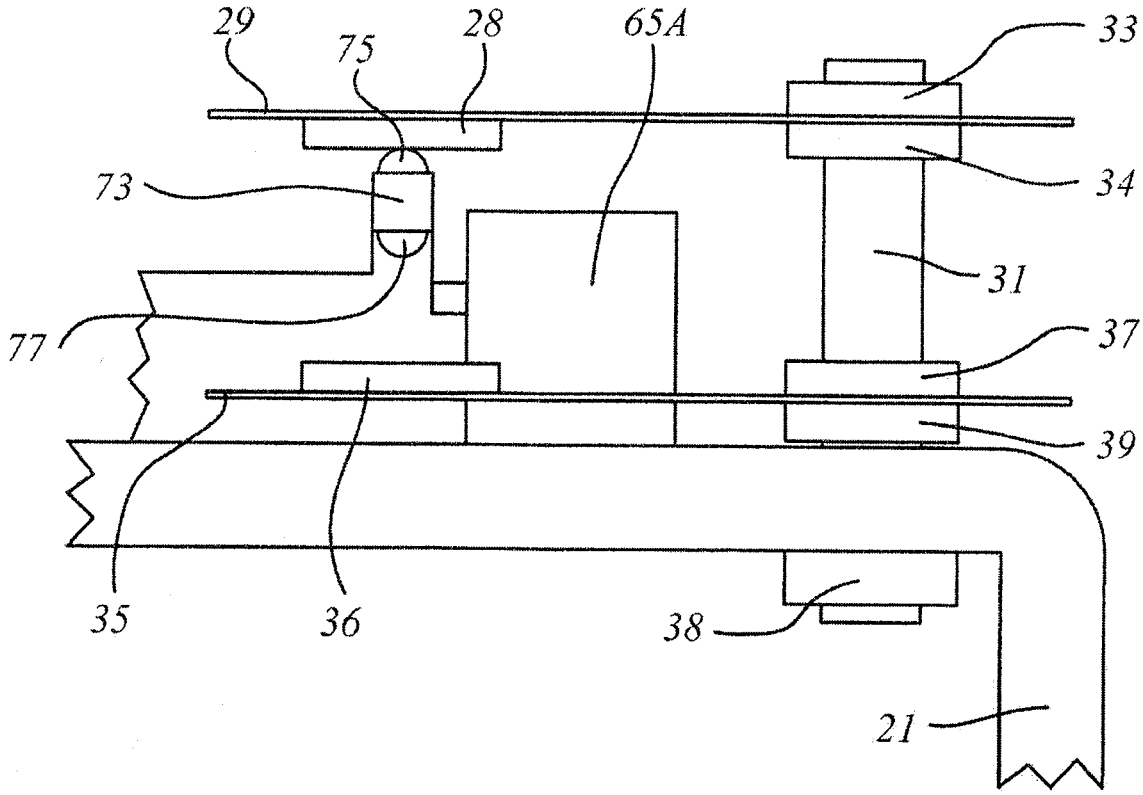
FIG. 6 is an enlarged sectional view of a flow sensing mechanism of the pump of FIG. 5.

Now referring to FIG. 6, the armature sensor arm 73 is now raised and the armature sensor arm tubing full contact 75 is pressed against the tubing full contactor contact 28. Tubing full contactor contact 28 is connected, such as by welding, to the tubing full contactor 29, which in turn is attached to the flow sensor post 31 by tubing full contactor upper nut 33 and tubing full contactor lower nut 34. This contact sends a tubing full signal to the control module 101 (not shown). The switching arrangement described herein is certainly not the only possible embodiment that can detect the opening or closing of the pump tubing segment, and any suitable arrangement may be employed. For example, an optical arrangement or even a flux measuring arrangement could be implemented to detect the shown positions.

Referring again to the fill stroke process shown in FIG. 12, after turning on the armature electromagnet at state 635, the control module waits for the tubing full signal at decision state 650, until the maximum fill time has been exceeded. If the maximum fill time is exceeded at decision state 655 before the tubing full signal is received, an upstream occlusion alarm is generated at state 660. During this time the control module also tests for an air signal from the air detector 99 at state 640. If an air signal is detected, an air alarm is generated at state 645. No air signal will be generated if the air detector is off.

Having successfully completed the fill stroke without the detection of air, the control module 101 may now power down the air detector 99 at state 665 to conserve power. This is the completion of the fill stroke of the infusion cycle. At process 700, the infusion pump starts the pump stroke process, described below with reference to FIGS. 13 and 9. If the pincher failure, air, or upstream occlusion alarm is generated, the fill stroke process terminates at end state 670.

Figure 13:
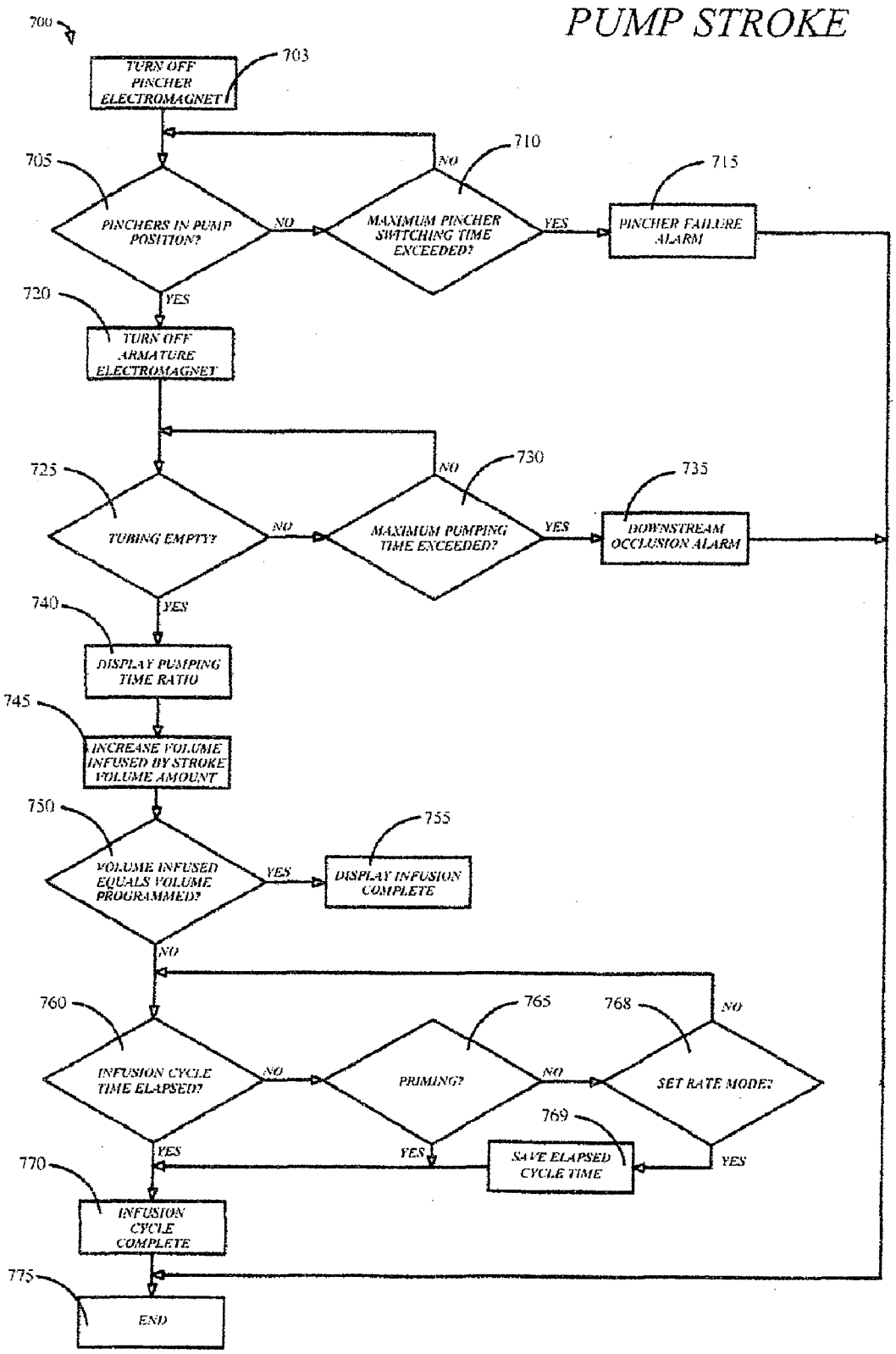
FIG. 13 is a flow chart of a pump stroke process of the pump of FIG. 5.

Turning now to the pump stroke process 700 illustrated in FIG. 13, the control module de-energizes the pincher electromagnet 49 at state 703. As shown in FIG. 9, the force from the rocker magnet 62 causes the rocker 55 to pivot counter clockwise forcing rocker leaf spring 57 to push upstream pincher 61A against pump tubing 25 (thereby stopping fluid flow through the tubing). Rocker leaf spring 57 has separated from upstream leaf spring pre-load screw 63*b*. This opens upstream contact switch 64A and sends a signal to the control module. This counterclockwise motion also causes downstream pincher 61A to be drawn slightly away from pump tubing 25 (thereby allowing fluid flow through the tubing). Rocker leaf spring 57 is in contact with downstream leaf spring pre-load screw 63A because the force exerted on the downstream pincher 61A by the pump tubing 25 is less than the force exerted on the downstream leaf spring pre-load screw 63A by rocker leaf spring 57. This closes the downstream contact switch 64B and sends a signal to the control module. The opening of the pump tubing 25 adjacent the downstream pincher 61A does not occur until the pump tubing 25 adjacent the upstream pincher 61B has closed, thereby stopping backflow during the transition.

The above-described pincher transition from the fill position to the pump position is monitored by the control module at decision state 705. If the pump position is not attained by the pinchers before the maximum pincher switching time is exceeded at decision state 710, then a pincher failure alarm is generated at state 715. If the pump position is attained before the maximum pincher time has elapsed, the armature electromagnet 47 is then turned off at state 720.

Without the attractive force on the armature 23 by the armature magnet core 87, the force generated by the right and left magnets 43A and 43B (not shown in FIG. 9), in opposition to the natural opening force of the pump tubing, will attempt to pivot the armature, collapse the tubing, and infuse the tubing contents downstream to the optional flow controlling orifice 107.

In the event that the downstream fluid path is not restricted and the downstream fluid pressure is not at an unacceptably high pressure, the armature 23 will pivot clockwise, collapse the tubing, and infuse the fluid to the optional flow controlling orifice 107. This pump sequence is referred to as the pump stroke. At the end of this pump stroke, the armature is resting flat against the right and left magnets. For example, FIG. 7B shows the position of the armature sensor arm 73 with the armature sensor arm tubing empty contact 77 pressing against the tubing empty contactor contact 36, signaling to the control module 101 (not shown) that the pump tubing is empty, and the stroke infusion volume has been infused.

After turning off the armature electromagnet, the control module waits for the reception of the tubing empty signal at decision state 725. In the event that the downstream fluid path is restricted or at an unacceptably high pressure, the right and left magnets 43A and 43B will be unable to collapse the tubing and infuse the fluid before the maximum pumping time has elapsed at decision state 730. In that case, the armature sensor arm 73 will not move to the appropriate position to send the tubing empty signal to the control module 101. The control module 101 may then take the appropriate action to warn the user of the occlusion at state 735. Alternatively, if the occlusion is transitory or short lasting, the control module 101 may compensate for the reduced flow rate by reducing the infusion time interval on successive infusion strokes to make up for the transitory reduction in flow rate.

If the tubing empty signal is received before the maximum pumping time elapses, the ratio of the actual elapsed pumping time to the maximum allowable pumping time is displayed in an appropriate manner for the user at state 740. The volume infused is then increased by one stroke volume amount at state 745. The new volume infused amount is then compared with the programmed volume to be infused value at decision state 750. If the volume has been infused, then the infusion is complete and this information is displayed to the user at state 755. If the volume to be infused has not yet been infused and the infusion pump is not priming or in the set rate mode (described in greater detail below with reference to FIGS. 14-15), then the control module waits until the required infusion cycle time has elapsed, as illustrated in decision state 760. If the infusion pump is priming at decision state 765, then the infusion cycle is immediately terminated to start the next infusion cycle. If the infusion pump is in the set rate mode at decision state 768, then the elapsed cycle time is saved at state 769 and then the infusion cycle is terminated to start the next infusion cycle. If the infusion pump is neither priming nor in the set rate mode, then the infusion cycle is complete only after the required infusion cycle time has elapsed at state 770. If the pincher failure or downstream occlusion alarm is generated, the pump stroke process terminates at end state 775.

Operation of an Infusion Pump with Roller Clamp

Figure 14:
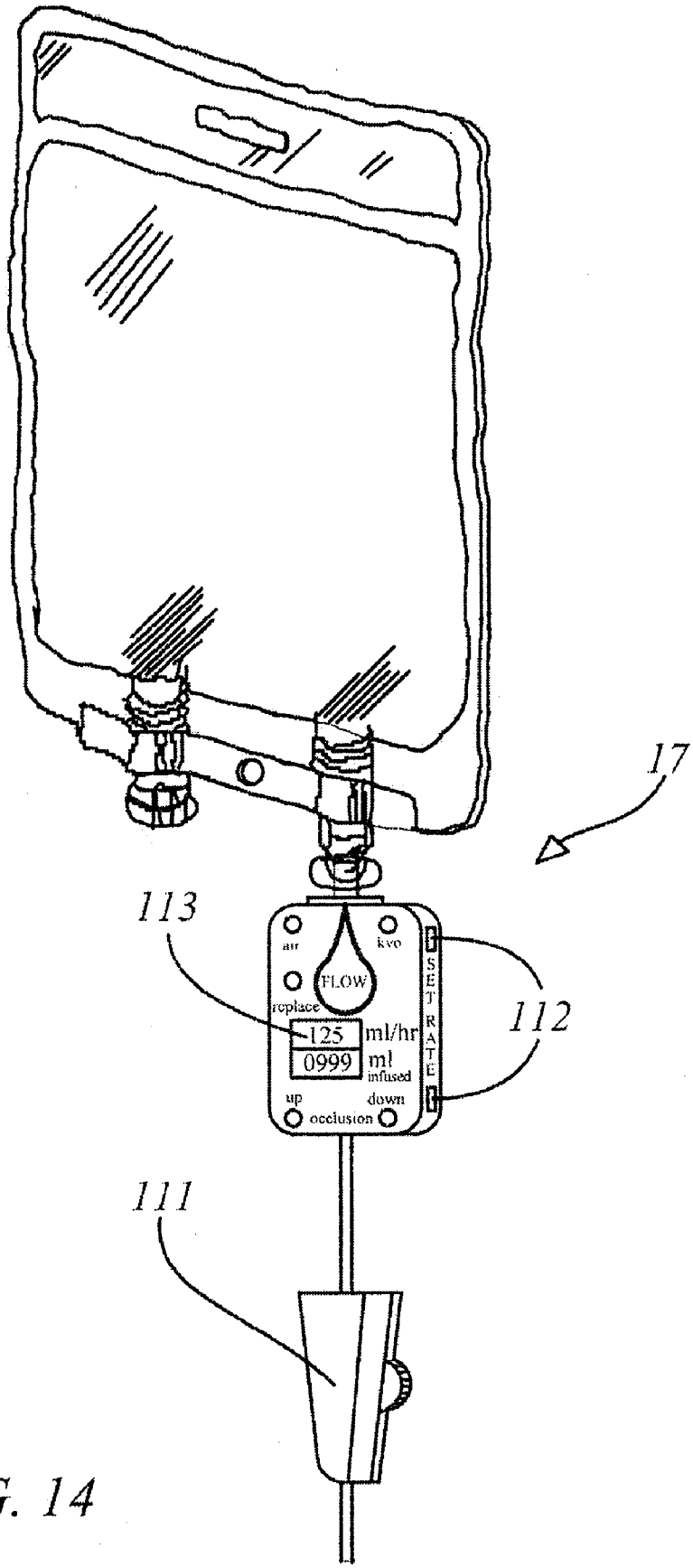
FIG. 14 is an enlarged view of the pump of FIG. 1 with a roller clamp.

An alternative embodiment of an infusion pump according to the present invention is illustrated in FIG. 14. This embodiment utilizes a conventional roller clamp 111 to establish an initial infusion rate, without the use of a programming device. Pump 17 is shown with conventional roller clamp 11, set rate switches 112, and infusion rate display 113.

Figure 15:
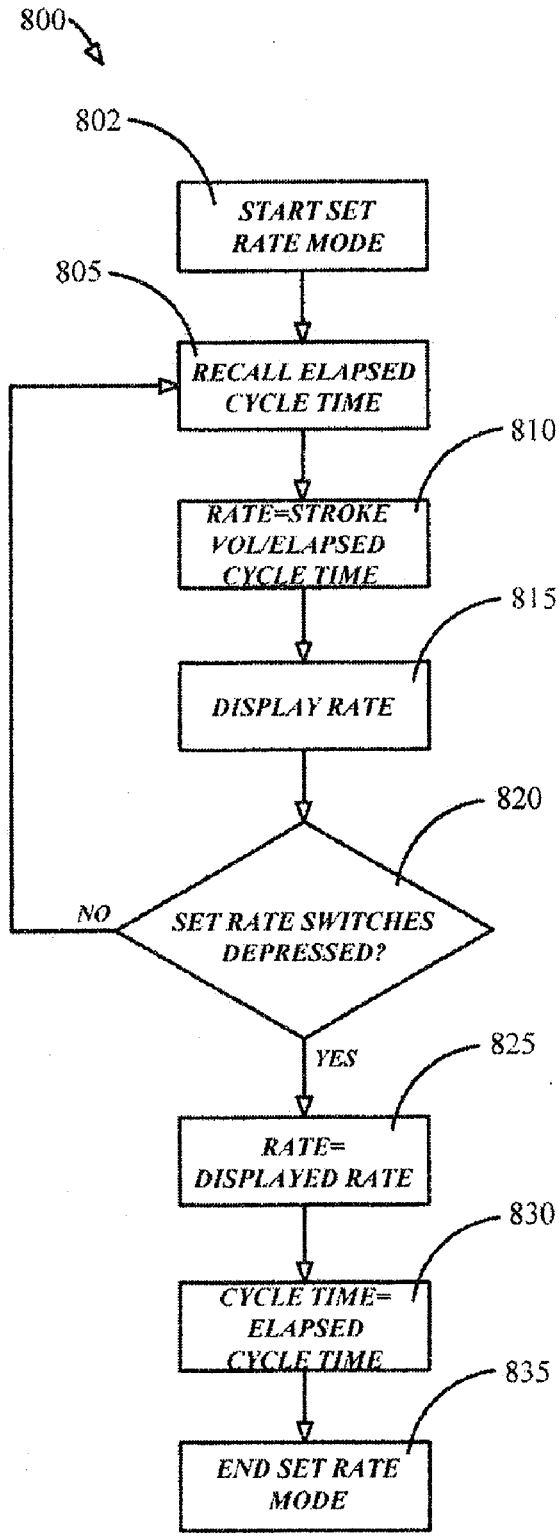
FIG. 15 is a flow chart of a rate setting process of the pump of FIG. 14.

The controlled infusion rate of the pump can be set according to the rate setting process 800 illustrated in FIG. 15. The infusion pump starts in the set rate mode at state 802. The pump starts and completes the fill cycle as previously described with reference to fill stroke process 600 illustrated in FIG. 12. Upon completion of the fill stroke, the pump executes the pump stroke process 700 as illustrated in FIG. 13. Since the pump is in the set rate mode, it saves the elapsed cycle time at state 769 at the end of the infusion cycle before it starts the next infusion cycle (illustrated at state 603 in FIG. 12).

Referring again to FIG. 15, the above-described saved elapsed cycle time at state 769 is recalled at state 805. The infusion rate is then calculated at state 810 by dividing the stroke volume by the elapsed cycle time. The infusion rate can be calculated by any suitable device, including but not limited to a control module, a measurement module, and an electronic device. As an example, the stroke volume might be 0.05 ml and the elapsed cycle time might be 1.44 seconds. In such a case, the calculated rate would be 125 ml/hr. The calculated rate of 125 ml/hr would then be displayed at state 815 on the infusion rate display 113, as illustrated in FIG. 14. If the displayed rate is not the rate desired by the user, the user would not depress the rate selection switches at decision state 820, and the next cycle time would be recalled at state 805. If the user desired a higher rate, the user would open the roller clamp further. The resulting new rate would then be displayed on rate display 113. If the user desired a lower rate, the user would close the roller clamp further. The resulting new rate would then be displayed on rate display 113. When the desired infusion rate is displayed, the user could then, at decision state 820, activate a control input that sets the infusion rate to the desired rate, such as, for example, by depressing the set rate switches 112. Upon depression of the switches, the infusion pump control rate is set to the display rate at state 825 and, at state 830, the cycle time is set to the previously recalled elapsed cycle time from state 805. Activating the set rate switches 112, or in some embodiments, a second control input, terminates the set rate mode and activates the infusion pump to pump at the selected rate. The infusion pump then continues as though the infusion rate had been obtained from a programming device. The user may then fully open the roller clamp and the selected infusion rate will be maintained automatically by the infusion pump.

It will be understood by persons of skill in the art that the above-described magnet arrangements are not limited to positions and locations described herein. Magnets may be advantageously positioned to move pump components and safely infuse medicament to a patient. For example, in one embodiment of the present invention, magnet arrangements on a rocker arm and on an armature force an upstream pincher and the armature closed when their respective electromagnets are de-energized. This results in a default safe condition in the event that power to the system is interrupted. In representative embodiments, the closed pincher and armature protect against free flow of fluid to the patient. In another embodiment of the present invention, all electromagnets are energized or "on" during the fill stroke and deenergized or "off" during the pumping stroke. This arrangement can again result in a default safe condition in the event that power to the system is interrupted.

Persons of skill in the art will understand that the invention is not limited to electromagnet arrangements to move various components. Other devices may be advantageously provided to move the armature and the pinchers. For example, in one embodiment of the present invention, a solenoid moves the armature during the fill and pump strokes. The operation of the solenoid may be controlled by the control module. Similarly, the various magnet arrangements described herein are not limited to a particular type of magnet, as permanent magnets, electromagnets, or both can be advantageously provided. In addition, persons of skill in the art will understand that the above-described detent arrangements are not limited to the mechanisms described herein. In one embodiment, for example, pinchers and anvils are used to constrain the tubing, instead of pinchers and detents. The anvils can be made of any suitable material, such as but not limited to, plastic.

It will also be understood by persons of skill in the art that all or various components of the present invention may be disposable. Embodiments of the present invention may include disposable single-use pumps that infuse medicament to a single patient over a lifespan of three to four days, for instance. In some embodiments, the tubing mechanism and air detector may be disposable, single-use components, while the flow sensor mechanism may be a permanent pump component for use on successive patients.

Finally, it will be understood by persons of skill in the art that the present invention is not limited in the type or size of magnet, type or size of tubing, or type or viscosity a of medicament.

Experimental Results

Figure 16A:
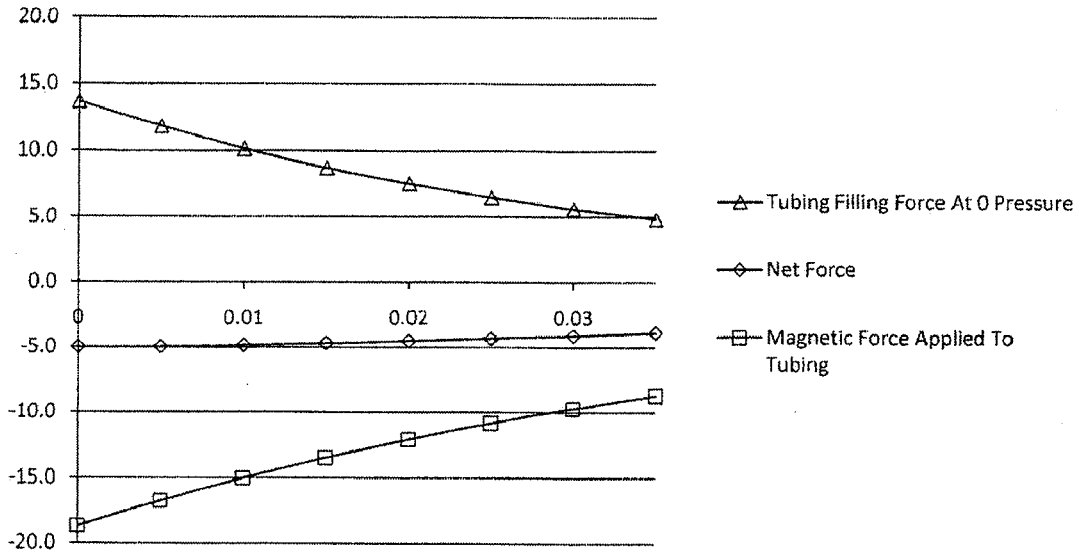
FIG. 16A is a graph of forces present in the fill stroke of the pump shown in FIG. 7A.

The results of one experiment are shown in FIG. 16A. The force (designated "Tubing Filling Force at 0 Pressure") exerted by a representative section of tubing filled with fluid at 0 psi pressure was shown to vary from about 5 ounces at a tubing gap of 0.035 inches to about 13.5 ounces when flattened at a tubing gap of 0 inches. The shape of the force curve over this range was nonlinear in nature. In the same experiment, a magnetic force (designated "Magnetic Force Applied to Tubing") was applied to the tubing. The shape of the applied force resembled the shape of the force curve of the tubing. The size of the applied force was about 8.1 ounces at a tubing gap of 0.035 inches and about 18.5 ounces at a flattened tubing gap of 0 inches. This force is slightly larger than the force required to compress the tubing when pressurized at maximum pressure and is the same magnet force applied to the tubing during the pump stroke, as described above with reference to pump stroke process 700 illustrated in FIG. 13. As shown in FIG. 16A, the difference between these two forces (designated net force) is somewhat more linear in shape and varies from about −4 ounces (the minus sign indicates that the direction of the force is in the direction of compressing the tubing) at a tubing gap of 0.035 inches and about −5 ounces at a collapsed tubing gap of 0 inches.

In order to open and fill the above collapsed tubing, an external force with a magnitude slightly greater than the designated net force must be applied to the tubing in the direction of opening the tubing. In an embodiment of the invention illustrated in FIG. 7A, this force is supplied by the armature electromagnet as it pivots the armature to open the tubing. As the tubing opens from a collapsed gap of 0 inches to a gap of 0.035 inches, energy is transferred from the elastic energy in the tubing walls and the armature electromagnetic field to the field of the magnet. It was found that increasing the pressure in the tubing during this fill stroke did not result in a failure of the tubing to open when the armature electromagnetic field was applied. However, decreasing the pressure in the tubing slightly did cause the tubing to fail to fully open and thereby fail to "fill" with fluid. Embodiments of the present invention, such as that shown in FIG. 7A, could detect this failure to "fill" and generate an upstream occlusion alarm.

Figure 16B:
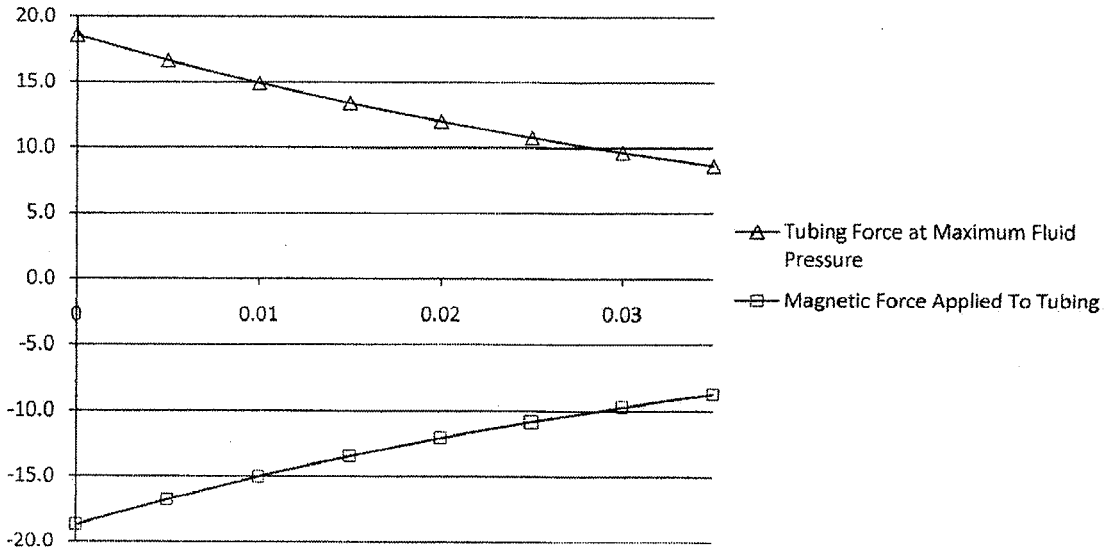
FIG. 16B is a graph of forces present in the pump stroke of the pump shown in FIG. 7B.

Further results of the experiment are shown in FIG. 16B. The force (designated "Tubing Force at Maximum Fluid Pressure") required to collapse a representative section of pressurized tubing is shown to vary from about 8 ounces at a tubing gap of 0.035 inches to about 18.5 ounces when flattened at a tubing gap of 0 inches. The shape of the force curve over this range was nonlinear in nature. In the same experiment, a magnetic force (designated "Magnetic Force Applied to Tubing") was applied to the tubing. The shape of the curve of the applied force resembled the shape of the force curve of the tubing. The size of the applied force was only slightly larger than the force exerted by the pressurized tubing so that the applied force caused the tubing to be compressed. It was found that reducing the pressure in the tubing did not result in a failure of the magnet to collapse the tubing and thereby fail to "pump" the fluid out of the tubing. However, increasing the pressure in the tubing slightly did cause the magnet to fail to collapse the tubing, and therefore the fluid failed to "pump" out of the tubing. Embodiments of the present invention, such as those shown in FIG. 7B, could detect this failure to collapse the tubing and generate a downstream occlusion alarm.

Again referring to FIG. 16B, because the applied magnet collapsing force is greater than the tubing force at maximum pressure, no additional forces need be applied to collapse the tubing. Energy is transferred from the field of the magnet to elastic energy in the tubing walls as the tubing transitions from an open to collapsed state.

In summary, it was found in this experiment that no force was required to open the tubing under 0 pressure when the magnet force was not present. An applied force from about −5 ounces to about −4 ounces was required to open the tubing when the magnetic force was present. It was also found that the force required to collapse the tubing under maximum pressure without the magnetic force present varied from about 18.5 ounces to about 8.1 ounces. The addition of the magnetic force caused the tubing to collapse entirely without any additional force applied. In this experiment, the addition of a magnetic collapsing force to the tubing resulted in a reduction of peak force from about 18.5 ounces to about 5 ounces, thereby significantly reducing both the size and the power requirements required to evacuate and fill the tubing.

The above-described embodiments have been provided by way of example, and the present invention is not limited to these examples. Multiple variations and modifications to the disclosed embodiments will occur, to the extent not mutually exclusive, to those skilled in the art upon consideration of the foregoing description. Additionally, other combinations, omissions, substitutions and modifications will be apparent to the skilled artisan in view of the disclosure herein. Accordingly, the present invention is not intended to be limited by the disclosed embodiments.

What is claimed is:

1. A device for pumping fluid from an upstream fluid source to a downstream patient, comprising:

a tubing disposed between said fluid source and said patient;

a pumping element which uncompresses the tubing to draw fluid from the fluid source using a first predetermined force and compresses the tubing using a second predetermined force to pump fluid to the patient, wherein the motion of said pumping element changes in response to pressure changes in the tubing; and a sensor configured to sense occlusions both upstream and downstream from said device by sensing changes in the position of said pumping element.

2. The device of claim 1, wherein said first and second predetermined forces are derived from one or more permanent magnets.

3. The device of claim 1, wherein the pumping element comprises an armature linked to a magnet.

4. The device of claim 1, wherein the first and second predetermined forces result from an attraction of the pumping element to a permanent magnet.

5. The device of claim 1, wherein the motion of the pumping element changes by not fully compressing the tubing when a downstream occlusion is present.

6. The device of claim 1, wherein the motion of the pumping element changes by not fully uncompressing the tubing when an upstream occlusion is present.

7. The device of claim 1, wherein the sensor is mounted adjacent the pumping element and configured to detect if the pumping element fully compresses and uncompresses the tubing.

8. The device of claim 1, wherein said first predetermined force is small enough to allow the tubing to fill at a pressure and large enough to prevent the tubing from filling at less than said pressure.

9. The device of claim 1, wherein said second predetermined force is large enough to allow the tubing to empty at a pressure and small enough to prevent the tubing from emptying at a pressure greater than said pressure.

10. A method of pumping fluid with a pumping element from an upstream fluid source to a downstream patient, wherein a tubing is disposed between said fluid source and said patient, the method comprising:

uncompressing said tubing with said pumping element using a first predetermined force to draw fluid from said fluid source;

compressing said tubing with said pumping element using a second predetermined force to pump fluid to said patient; and sensing occlusions in said tubing by measuring the position of the pumping element in response to the first and second predetermined forces.

11. The method of claim 10, wherein compressing further comprises applying a force from a permanent magnet to attract the pumping element to compress said tubing.

12. The method of claim 10, wherein sensing further comprises sensing upstream occlusions.

13. The method of claim 10, wherein sensing further comprises sensing downstream occlusions.

14. The method of claim 10, wherein the first and second predetermined forces result from an attraction of the pumping element to one or more permanent magnets.

15. The method of claim 10, wherein the pumping element does not fully compress the tubing when a downstream occlusion is present.

16. The method of claim 10, wherein the pumping element does not fully uncompress the tubing when an upstream occlusion is present.

17. The method of claim 10, wherein uncompressing further comprises using a first predetermined force small enough to allow the tubing to fill at a pressure and large enough to prevent the tubing from filling at less than said pressure.

18. The method of claim 10, wherein compressing further comprises using a second predetermined force large enough to allow the tubing to empty at a pressure and small enough to prevent the tubing from emptying at a pressure greater than said pressure.

* * * * *